US008133646B2

(12) United States Patent
Anno et al.

(10) Patent No.: US 8,133,646 B2
(45) **Date of Patent: *Mar. 13, 2012**

(54) TONER

(75) Inventors: Masahiro Anno, Tokyo (JP); Masahiko Nakamura, Tokyo (JP); Tsuyoshi Uchida, Tokyo (JP); Kenichi Onaka, Tokyo (JP); Junya Onishi, Tokyo (JP); Naoya Tonegawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 428 days.

This patent is subject to a terminal disclaimer.

(21) Appl. No.: 12/406,259

(22) Filed: Mar. 18, 2009

(65) Prior Publication Data

US 2009/0239171 A1 Sep. 24, 2009

(30) Foreign Application Priority Data

Mar. 21, 2008 (JP) ..... 2008-073007

(51) Int. Cl.
*G03G 9/00* (2006.01)

(52) U.S. Cl. ..... 430/108.7; 430/108.1; 430/109.1; 430/109.3

(58) Field of Classification Search ..... 430/108.1, 430/108.6, 108.7, 109.1, 109.3
See application file for complete search history.

(56) References Cited

U.S. PATENT DOCUMENTS

| | | | | |
|---|---|---|---|---|
| 6,897,001 | B2 * | 5/2005 | Mizoe et al. | 430/108.6 |
| 7,144,628 | B2 * | 12/2006 | Kudo et al. | 428/405 |
| 7,160,663 | B2 * | 1/2007 | Komoto et al. | 430/109.1 |
| 2006/0204878 | A1 * | 9/2006 | Anno et al. | 430/108.6 |
| 2008/0176162 | A1 * | 7/2008 | Ohmura et al. | 430/110.3 |
| 2009/0208862 | A1 * | 8/2009 | Anno et al. | 430/108.7 |

FOREIGN PATENT DOCUMENTS

| | | |
|---|---|---|
| JP | 2004126544 | 4/2004 |
| JP | 200591525 | 4/2005 |
| JP | 200591696 | 4/2005 |

* cited by examiner

*Primary Examiner* — Mark F Huff
*Assistant Examiner* — Stewart Fraser
(74) *Attorney, Agent, or Firm* — Lucas & Mercanti, LLP

(57) ABSTRACT

It is to provide a toner which can form an image of high image quality exhibiting high resolution wherein a final visible image exhibits high image density and high thin-line reproducibility even in long-term use. In a toner incorporating at least a colored particle containing a binder resin composed of a polyester resin and a colorant, and external additive particles, the toner has a degree of average circularity of 0.950-0.990, a volume based median diameter of 4.5-8.0 μm, a volume based particle diameter dispersibility ($CV_{VOL}$ value) of 15-25; a metal selected from titanium, germanium, and aluminum is incorporated at a ratio of 10-1500 ppm; the above external additive particles is composed of a composite oxide incorporating a silicon atom and at least either of a titanium atom and an aluminum atom; and the existence ratio of silicon atoms in the surface thereof is higher than the existence ratio of silicon atoms in the entire part thereof.

11 Claims, 1 Drawing Sheet

TONER

This application is based on Japanese Patent Application No. 2008-073007 filed on Mar. 21, 2008 in Japanese Patent Office, the entire content of which is hereby incorporated by reference.

TECHNICAL FIELD

The present invention relates to a toner used for an image forming method based on an electrophotographic method.

BACKGROUND

Over recent years, image forming apparatuses based on electrophotographic methods have been used as common copiers and printers in offices to print documents as well as for simple copying, and moreover have expanded their application to the area of preparing printed materials used outside offices, specifically to the print-on-demand (POD) market, which is included in the quick-printing market, since variable information from electronic data is readily printed. Accordingly, various copiers and printers have been installed in offices, resulting in increased power consumption as a whole.

In the POD market, a practical value is sought not for copying but for printed materials themselves. Therefore, these printed materials have needed to be produced with high image quality.

To obtain printed materials exhibiting high image quality, it is known that it is effective to decrease the particle diameter of a toner. To realize the above, various types of so-called chemical toners have been proposed. Such chemical toners are produced via a method to carry out granulation in an aqueous medium, and therefore have the advantage that toner particles of relatively small particle diameter are obtained with enhanced uniformity, compared to those produced via a pulverization method.

In contrast, to obtain printed materials exhibiting high image quality by providing enhanced glossiness with no occurrence of offset phenomena during fixing, it is known that it is effective to use polyester resins as binder resins constituting toner particles.

Then, as a method to prepare a toner of decreased particle diameter using a polyester resin, there is proposed a method to obtain toner particles wherein a polyester resin is dissolved or dispersed in a solvent and dispersed in an aqueous medium to form oil droplets, followed by desolvation.

As catalysts used to synthesize a polyester resin via polycondensation, catalysts composed of tin compounds such as dibutyltin are commonly used (for example, refer to Patent Document 1).

However, in this method, a colorant is dissolved or dispersed in a solvent together with a polyester resin, followed by granulation. Therefore, there is noted such a problem that dispersibility of the colorant in toner particles obtained is decreased.

Further, tin compounds used as catalysts as described above are organotin compounds featuring a structure wherein an aliphatic substituent is bonded to a metal (tin). It has recently been pointed out that such organotin compounds are problematic in environmental soundness and safety. Therefore, use of these catalysts is being reviewed.

From the viewpoint of such environmental consciousness, there have been recently proposed metal catalysts including titanium catalysts such as titanium halides, titanium diketone enolates, titanium carboxylates, titanyl carboxylates, and titanyl carboxylate salts; germanium catalysts; and aluminum catalysts (refer to Patent Documents 2-4).

However, when a toner based on a polyester resin obtained employing such a specific metal catalyst is used over a long term period, there is produced such a problem that image density of visible images formed is gradually decreased.

[Patent Document 1] Unexamined Japanese Patent Application Publication (hereinafter referred to as JP-A) No. 2005-173570

[Patent Document 2] JP-A No. 2004-126544

[Patent Document 3] JP-A No. 2005-91696

[Patent Document 4] JHP-A No. 2005-91525

SUMMARY

In view of the above circumstances, the present invention was completed. An object of the present invention is to provide a toner wherein even when the toner is used over a long term period, a final visible image obtained exhibits high image density and high thin-line reproducibility, whereby a high quality image exhibiting high resolution can be formed. The present inventors conducted diligent investigations. Thereby, it was presumed that when a specified amount of a metal (hereinafter also referred to as "a specific catalyst metal") selected from titanium, germanium, and aluminum exists in a toner particle, enhanced dispersibility of a colorant to a polyester resin can be realized; however, such a specific catalyst metal, existing at a minute amount, is bonded to the polyester resin to form an ionic cross-linking structure, whereby so-called charge providing properties are exerted; and thereby, when the toner is used over a long term period, electrical charge is accumulated in the toner inside the developing unit, resulting in decreased developability.

To solve the problem of such charge accumulation, it was thought that when those specified as an external additive fine particle, that is, those capable of inhibiting the charge accumulation are used, stable visible images can be formed over a long term period. Thus, the present invention was completed.

The toner of the present invention is characterized in that a toner comprising colored particles and external additive particles, wherein the colored particles comprise a binder resin made of a polyester resin and a colorant;

wherein the toner has a degree of average circularity of 0.950-0.990, a volume based median diameter of 4.5-8.0 μm, a volume based particle diameter dispersibility ($CV_{VOL}$ value) of 15-25, a metal selected from titanium, germanium, and aluminum incorporated at a ratio of 10-1500 ppm;

wherein external additive particles comprise a complex oxide incorporating silicon atoms and at least one of titanium atoms and aluminum atoms; and wherein a coefficient $(R_1)/(R_2)$ is 1.0 or less, provided that the surface existing ratio of the silicon atoms ($R_2$) is defined as a value obtained from a weight of silicon atoms in the surface divided by the total weight of the silicon atoms, the titanium atoms and the aluminum atoms in the surface; and the average existing ratio of the silicon atoms ($R_1$) is defined as a value obtained from a weight of silicon atoms in the entirety of the external additive particles divided by the total weight of the silicon atoms, the titanium atoms and the aluminum atoms in the entirety of the external additive particles.

Herein, the composite oxide represents an oxide incorporating at least 2 kinds of metal atoms.

With regard to the toner of the present invention, in the above external additive fine particle, the mass content of silicon atoms in the external additive fine particle is at most 49% of the total mass content of silicon atoms, titanium atoms, and aluminum atoms.

Further, with regard to the toner of the present invention, the number average primary particle diameter of the above external additive fine particle is preferably 20-200 nm.

Still further, with regard to the toner of the present invention, the coefficient $(R_1)/(R_2)$ of the external additive fine particle is preferably at most 0.7.

Still further, with regard to the toner of the present invention, the coefficient $(R_1)/(R_2)$ of the external additive fine particle is preferably at most 0.5.

Still further, with regard to the toner of the present invention, the coefficient $(R_1)/(R_2)$ of the external additive fine particle is preferably at most 0.25.

Still further, with regard to the toner of the present invention, the amount of the silicon atoms contained in the external additive particles is 1-20% of the total amount of the silicon atoms, the titanium atoms and the aluminum atoms in the external additive particles.

Still further, with regard to the toner of the present invention, a BET of the external additive particles is 2-100 $m^2/g$.

Still further, with regard to the toner of the present invention, a bulk density of the external additive particles is 100-400 g/l.

Still further, with regard to the toner of the present invention, a degree of hydrophobization of the external additive particles is 30% or more.

Still further, with regard to the toner of the present invention, an added amount of the external additive particles is 0.1-2.0% based on the amount of the colored particles.

According to the toner of the present invention, toner particles constituting the toner are composed of a polyester resin and have a specified small particle diameter, whereby high quality images can basically be obtained; specified narrow particle diameter dispersibility makes it possible to prevent the existence of toner particles having excessively small or large particle diameter, whereby enhanced adhesion among the toner particles during fixing can be realized; and further, a specified amorphous shape makes it possible to minimize the gap among the toner particles, whereby further enhanced adhesion among the toner particles can be realized during fixing, resulting in no spreading of the toner. Therefore, in an image obtained, thin-line reproducibility and high image density can be realized. Further, since a specific catalyst metal is incorporated at a specified ratio and also a specific external additive fine particle is incorporated, high image density can be realized over a long term period.

Unclear is the reason why since a specific catalyst metal is incorporated at a specified ratio and also a specific external additive fine particle is incorporated, high image density can be realized over a long term period. However, it is presumed that via the interaction between the specific catalyst metal and the polyester resin, an ionic cross-linking structure is formed, and a portion, where this ionic crosslinking structure has been formed, functions as a charge generating point, resulting in stable charge providing properties; further, the specific external additive fine particle can inhibit excessive charge accumulation, resulting in an excellent balance between charge providing properties and charge accumulation inhibiting properties; and thereby, high image density can be realized over a long term period.

DESCRIPTION OF THE PREFERRED EMBODIMENT

Figure 1:
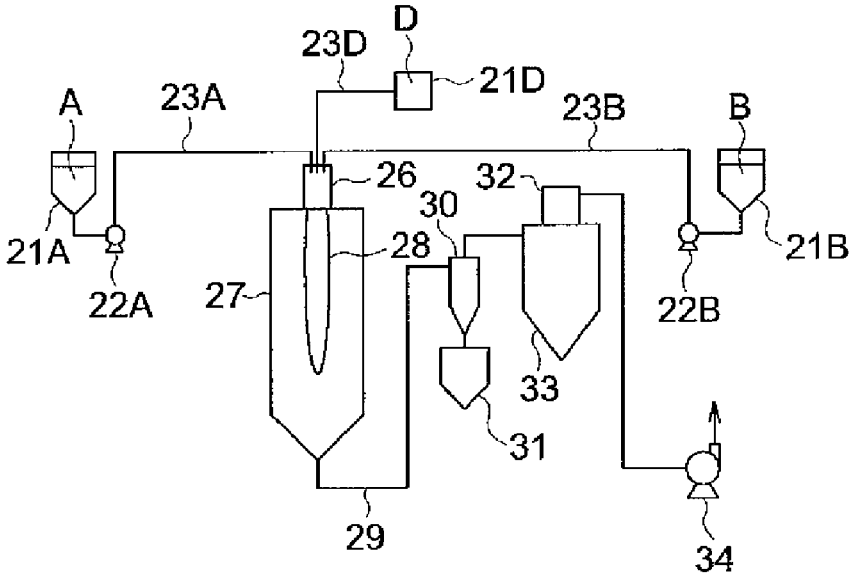
FIG. 1 A schematic view showing one example of a production apparatus to produce an external additive fine particle constituting the toner of the present invention via a gas phase method using powder.

The present invention will now be detailed.

[Toner]

The toner of the present invention incorporates at least a colored particle containing a binder resin composed of a polyester resin and a colorant, and an external additive fine particle. The toner has a degree of average circularity of 0.950-0.990, a volume based median diameter of 4.5-8.0 μm, a volume based particle diameter dispersibility ($CV_{VOL}$ value) of 15-25; a metal selected from titanium, germanium, and aluminum is incorporated at a ratio of 10-1500 ppm; and the above external additive fine particle is a specific external additive fine particle to be described later.

Herein, such a metal is preferably incorporated via dispersion in a binder resin constituting toner particles.

[Average Particle Diameter of Toner]

The average particle diameter of the toner of the present invention is 4.5-8.0 μm, preferably 4.0-7.5 μm in terms of volume based median diameter. When the average particle diameter of the toner falls within the above range in terms of volume based median diameter, there is decreased the number of toner particles exhibiting a large adhesive force causing fixing offset due to adhesion to a heating member via flying during fixing, and also transfer efficiency is enhanced, resulting in enhanced halftone image quality and enhanced thin-line and dot image quality.

The average particle diameter of this toner can be controlled by the concentration of a coagulant, the added amount of an organic solvent, or the fusing duration in the aggregation process during toner production, and further by the composition of a polyester resin.

The volume based median diameter of a toner is measured and calculated using a device constituted of "Coulter Multisizer III" (produced by Beckman Coulter, Inc.) and a data processing computer system (produced by Beckman Coulter, Inc.) connected thereto.

Specifically, 0.02 g of a toner is initially added in 20 ml of a surfactant solution (being a surfactant solution prepared, for example, via ten-fold dilution of a neutral detergent containing a surfactant component with purified water to disperse the toner), followed by being wetted and then subjected to ultrasonic dispersion for 1 minute to prepare a toner dispersion. This toner dispersion is injected into a beaker, containing electrolyte solution "ISOTON II" (produced by Beckman Coulter, Inc.), set on the sample stand, using a pipette, until the concentration indicated by the measurement device reaches 8%. Herein, this concentration range makes it possible to obtain reproducible measurement values. Using the measurement device, under conditions of a measured particle count number of 25,000 and an aperture diameter of 50 μm, the frequency is calculated by dividing a measurement range of 1-30 μm into 256 parts, and the particle diameter at the 50% point from the higher side of the volume integral fraction (namely the volume D50% diameter) is designated as the volume based median diameter.

[Volume Based Particle Diameter Dispersibility ($CV_{VOL}$ Value)]

The volume based particle diameter dispersibility ($CV_{VOL}$ value) of the toner of the present invention is 15-25, preferably 15-22.

This volume based particle diameter dispersibility ($CV_{VOL}$ value) is determined by Expression (x) described below. Herein, in Expression (x), the arithmetic average value of volume based particle diameters is calculated using 25,000 toner particles. This value is measured using "Coulter Multisizer III" (produced by Beckman Coulter, Inc.).

$$CV_{VOL}\text{ value}=\{(\text{standard deviation})/(\text{arithmetic average value of volume based particle diameters})\}\times 100 \quad \text{Expression (x)}$$

Narrow volume based particle diameter dispersibility ($CV_{VOL}$ value), as described above, makes it possible to prevent the existence of toner particles of excessively small or large particle diameter, whereby enhanced adhesion among the toner particles during fixing can be realized. Thereby, with regard to printed materials produced, high thin-line reproducibility and high image density can be realized.

[Degree of Average Circularity of Toner Particles]

In the toner of the present invention, the degree of average circularity of individual toner particles constituting the toner is 0.950-0.990, preferably 0.955-0.980.

When the degree of average circularity falls within the range of 0.950-0.990, high thin-line reproducibility and high image density can be realized in printed materials produced.

As the reason for realization of such high thin-line reproducibility and high image density, it is thought that conventionally, in a toner of decreased particle diameter, the thickness of toner particles is relatively small, whereby the covering rate per toner particle is decreased compared to a toner of relatively large particle diameter, and in a toner of decreased particle diameter with decreased covering rate, the existence of voids among toner particles adversely affects reproducibility of thin-line portions made via the existence of monolayered toner particles, whereby high thin-line reproducibility does not result, and high image density cannot be realized; however, the shape of toner particles is amorphous as described above makes it possible to minimize voids among the toner particles.

The degree of average circularity of toner particles refers to a value determined using "FPIA-2100" (produced by Sysmex Corp.), specifically, a value calculated as follows: a toner is wetted with an aqueous solution containing a surfactant, followed by being dispersed via ultrasonic dispersion treatment for 1 minute, and then photographed with "FPIA-2100" (produced by Sysmex Corp.) in a measurement condition HPF (high magnification photographing) mode at an appropriate density of an HPF detection number of 3,000-10,000; the degrees of circularity of the individual toner particles are calculated based on Expression (z) described below; and the degree of circularity of each toner particle is added, and the resulting value is divided by the total number of the toner particles. The HPF detection number falling within the above range makes it possible to realize reproducibility.

$$\text{Degree of circularity}=(\text{circumference length of a circle having the same projective area as a particle image})/(\text{circumference length of the projective area of the particle}) \quad \text{Expression (z)}$$

A toner particle constituting the toner of the present invention incorporates a specific catalyst metal selected from titanium, germanium, and aluminum at a total ratio of 10-1500 ppm.

The content ratio of such a metal can be determined via a metal analysis method known in the art such as atomic absorption spectroscopy or plasma emission spectroscopy. The content ratio of a specific catalyst metal for the toner particle of the present invention is determined via metal quantitative analysis using high-frequency plasma emission spectrometer "SPS1200A" (produced by Seiko Instruments Inc.).

Herein, the specific catalyst metal refers to 1 type or at least 2 types of metals selected from titanium, germanium, and aluminum.

Such a specific catalyst metal is preferably incorporated in the form of an organic metal compound or a metal oxide, specifically preferably in the form of an organic metal compound. Further, this metal compound preferably has a skeleton such as a metal alcoholate.

The content ratio of this specific catalyst metal falling within the above range makes it possible to realize charge providing properties via the interaction between the specific catalyst metal and a polyester resin. Namely, when the content ratio of this specific catalyst metal falls within the above range, an ionic cross-linking structure is formed between a hydroxyl group or a carboxyl group present in the polyester resin and the specific catalyst metal, whereby a portion, where this ionic cross-linking structure has been formed, functions as a charge generating point.

When the content ratio of this specific catalyst metal is less than 10 ppm, an ionic cross-linking structure is formed to a minor extent, resulting in a decreased number of charge generating points and then in decreased charge providing properties, whereby tog is generated. In contrast, when the content ratio of this specific catalyst metal is more than 1500 ppm, an ionic cross-linking structure is formed to an excessive extent due to the existence of an excessive amount of the catalyst metal, resulting in an excessive number of charge generating points and then in excessively high charge providing properties, whereby image density is decreased.

Further, the acid value of a polyester resin constituting a colored particle for the toner of the present invention is preferably 5-45 mg·KOH/g, more preferably 5-30 mg·KOH/g. When the acid value of the polyester resin is excessively large, an image forming operation, carried out under an ambience of high temperature and humidity or low temperature and humidity, is susceptible to the ambience, whereby image deterioration may occur.

Still further, the glass transition point (Tg) of the polyester resin is 30-60° C., specifically preferably 35-54° C., and the softening point is 70-130° C., specifically preferably 80-120° C.

Herein, the glass transition point of the polyester resin is determined using differential scanning calorimeter "DSC-7" (produced by Perkin Elmer, Inc.) and thermal analyzer controller "TAC7/DX" (produced by Perkin Elmer, Inc.). Specifically, 4.50 mg of the toner is sealed in aluminum pan "Kit No. 0219-0041", and placed in a "DSC-7" sample holder. An empty aluminum pan is used as the reference measurement. Determination is carried out under conditions of a measurement temperature of 0-200° C., a temperature increasing rate of 10° C./minute, and a temperature decreasing rate of 10° C./minute via a heating-cooling-heating temperature control. Data is collected at the second heating. The glass transition point (Tg) is represented as the intersection of the extension of the base line, prior to the initial rise of the first endothermic peak, with the tangent showing the maximum inclination between the initial rise of the first endothermic peak and the peak summit. Herein, temperature is kept at 200° C. for 5 minutes during temperature increase at the first heating.

Further, the softening point is determined as follows: namely, initially, 1.1 g of the toner is placed in a petri dish under an ambience of 20° C. and 50% RH, followed by being made even and allowed to stand for at least 12 hours. Thereafter, a pressed sample of a 1 cm diameter columnar shape is prepared by applying a force of 3820 kg/cm$^2$ for 30 seconds using press instrument "SSP-10A" (produced by Shimadzu Corp.). Subsequently, using flow tester "CFT-500D" (produced by Shimadzu Corp.) under an ambience of 24° C. and 50% RH, this pressed sample is extruded through the columnar die orifice (1 mm diameter×1 mm) by use of a 1 cm diameter piston, starting at the time of termination of preheating, under conditions of a weight of 196 N (20 kgf), an initial temperature of 60° C., preheating duration of 300 seconds, and a temperature increasing rate of 6° C./minute. An offset method temperature $T_{offset}$, determined at an offset value of 5 mm via a melt temperature measurement method employing a temperature increasing method, is designated as the softening point.

Further, the number average molecular weight (Mn) of the polyester resin is preferably 3,500-400,000, more preferably 7,000-80,000, and the weight average molecular weight (Mw) thereof is preferably 5,000-500,000, more preferably 10,000-100,000, which are determined for a THF soluble part via gel permeation chromatography. When the molecular weight of the polyester resin falls within the above range, adequate low temperature fixability and excellent adhesion to an image support due to urea-modification is realized and breakage of toner particles in the developing unit is prevented, further resulting in a final fixed image of enhanced strength.

When the molecular weight of the polyester resin is excessively small, melt viscosity is decreased, whereby although adequate low temperature fixability is realized, toner particles themselves exhibit low strength to some extent, whereby breakage thereof due to stress may occur in the developing unit and then a final fixed image of decreased strength may be obtained. Further, when the molecular weight of the polyester resin is excessively large, melt viscosity is increased, whereby inadequate adhesion to an image support may result.

Molecular weight determination via GPC is carried out as follows. Namely, using apparatus "HLC-8220" (produced by Tosoh Corp.) and column "TSK guard column+TSR gel Super HZM-M (three in series)" (produced by Tosoh Corp.), while the column temperature is kept at 40° C., tetrahydrofuran (THF) serving as a carrier solvent is passed at a flow rate of 0.2 ml/minute, and a measurement sample (toner) is dissolved in the tetrahydrofuran so as for the concentration thereof to be 1 mg/ml under a dissolution condition wherein dissolution is carried out using an ultrasonic homogenizer at room temperature for 5 minutes. Then, a sample solution is obtained via treatment using a membrane filter of a 0.2 μm pore size, and 10 μl of this sample solution is injected into the above apparatus along with the carrier solvent for detection using a refractive index detector (RI detector). Subsequently, the molecular weight of the measurement sample is calculated using a calibration curve wherein the molecular weight distribution of the measurement sample is determined employing monodispersed polystyrene standard particles. As the standard polystyrene samples used to obtain the calibration curve, there are employed those featuring a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (produced by Pressure Chemical Co.). The calibration curve is drawn via measurement at about 10 points or more using these standard polystyrene samples. Further, as a detector, the reflective index detector is used.

When a binder resin is composed of a urea-modified polyester resin, negative chargeability possessed by the polyester resin on its own is reduced due to the existence of urea bonding, whereby a toner obtained is not excessively charged, and enhanced charge stability and enhanced adhesion to an image support are realized. Further, since both ester bonding and urea bonding are formed within the molecule, toner particles exhibit enhanced internal aggregation power, resulting in breakage resistance.

[Specific External Additive Fine Particles]

A specific external additive fine particle constituting the toner of the present invention is composed of a composite oxide incorporating a silicon atom and at least either of a titanium atom and an aluminum atom, and the existence ratio of silicon atoms in the surface layer thereof is higher than the existence ratio of silicon atoms in the entire part thereof.

Since in such an external additive fine particle, a large amount of silicon atoms are present on the surface thereof, a toner obtained via external addition of the external additive fine particle to a colored particle exhibits excellent mobility such as no packing phenomenon during stationary storage, similarly to a toner subjected to external addition using silica.

In the specific external additive fine particle, the meaning that "the existence ratio of silicon atoms in the surface layer thereof is higher than the existence ratio of silicon atoms in the entire part thereof" represents that a larger amount of silicon atoms are present on the surface, specifically, representing that when the existence ratio of silicon atoms in the entire part is designated as $R_1$ and the existence ratio of silicon atoms in the surface layer is designated as $R_2$, coefficient $(R_1)/(R_2)$ is less than 1.

Coefficient $(R_1)/(R_2)$ of silicon atoms is preferably at most 0.7, more preferably at most 0.5, specifically preferably at most 0.25.

Existence ratio $R_1$ of silicon atoms in the entire part of a specific external additive fine particle is calculated in such a manner that the mass content of at least one atom of silicon, titanium, and aluminum is determined using X-ray fluorescence (XRF) spectrometer "XRF-1800" (produced by Shimadzu Corp.) to carry out mass fractioning.

Specifically, the following steps of (1)-(3) are performed.

(1) Initially, as a sample for calibration curve preparation, at least one of the following pellets is prepared: namely, a silicon atom measurement pellet prepared by adding a known amount of silicon dioxide to 100 parts by mass of styrene powder; a titanium atom measurement pellet similarly prepared by adding a known amount of titanium oxide to 100 parts by mass of styrene powder; and an aluminum atom measurement pellet prepared by adding a known amount of aluminum oxide to 100 parts by mass of styrene powder.

(2) Subsequently, at least one of the thus-prepared silicon atom measurement pellet, titanium atom measurement pellet, and aluminum atom measurement pellet is subjected to X-ray fluorescence analysis, and then a calibration curve, for the silicon dioxide, the titanium oxide, or the aluminum oxide in the styrene powder, is prepared using peak intensity obtained from each corresponding pellet.

(3) Thereafter, a sample of the specific external additive fine particle is subjected to X-ray fluorescence analysis, and a peak intensity obtained is cross-checked with the calibration curve to quantitate the content of at least one atom of silicon, titanium, and aluminum.

Incidentally, in this determination, the Kα peak angle of an element to be measured is determined from the 2θ table and employed. Further, X-ray generating section conditions are as follows: target: Rh, tube voltage: 40 kV, tube current: 95 mA, and no filter used. Spectroscopic system conditions are as follows: slit: standard, no attenuator used, spectroscopic crystal: (Si=PET, Ti=LiF, and Al=PET), and detector: (Si=FPC, Ti=SC, and Al=FPC).

On the other hand, existence ratio $R_2$ of silicon atoms in the surface layer of the specific external additive fine particle is calculated in such a manner that the mass content of silicon atoms, titanium atoms, and aluminum atoms in the surface layer ranging from the surface to a depth of several nm (about 10 atom layers) is determined using X-ray photoelectron spectrometer "ESCA-1000" (produced by Shimadzu Corp.) to carry out mass fractioning.

Specifically, in the same manner as in above (1) and (2) for determination using an X-ray fluorescence (XRF) spectrometer, calibration curves were prepared for silicon atoms, titanium atoms, and aluminum atoms, and a sample of the specific external additive fine particle is measured via X-ray photoelectron spectrometry under the following conditions:

—Measurement Conditions—

X-ray intensity; 30 mA and 10 kV

Analysis depth: normal mode

Quantitative elements: Si, Ti, and Al elements quantitatively analyzed simultaneously In a specific external additive fine particle, the existence ratio of silicon atoms in the entire part thereof is preferably 1-49%, more preferably 1-20%.

Further, in the specific external additive fine particle, the existence ratio of silicon atoms in the surface layer ranging from the surface to a depth of several nm is preferably 70-100%, more preferably 80-100%.

When the existence ratio of silicon atoms in the entire part of an external additive fine particle is less than 1%, an external additive fine particle obtained may exhibit inadequate chargeability and a toner obtained via external addition to a colored particle may exhibit poor mobility. In contrast, when the existence ratio of silicon atoms in the entire part of an external additive fine particle is more than 49%, an external additive fine particle obtained may inadequately inhibit excessive charge. Further, when the existence ratio of silicon atoms in the surface layer is less than 70%, poor charge providing performance with respect to a colored particle may be expressed.

[Average Particle Diameter of an External Additive Fine Particles]

The number average primary particle diameter of a specific external additive fine particle is preferably 10-500 nm, more preferably 20-300 nm, specifically preferably 20-200 nm.

When the number average primary particle diameter falls within the above range, charge on the colored particle surface can be stabilized, and also the surface of the colored particle can highly stably hold a specific external additive fine particle itself.

The number average primary particle diameter of a specific external additive fine particle is determined using a scanning electron microscope (SEM).

Specifically, a SEM photograph enlarged at a magnification of 30,000 is read using a scanner, and binarization is carried out with respect to an external additive fine particle present on the toner surface in the SEM photographic image using image processing analyzer "LUZEX AP" (produced by Nireco Corp.). Then, Fere diameters in the horizontal direction with respect to 100 particles for one kind of external additive fine particle are calculated, and thereby the average value is designated as the number average primary particle diameter.

Herein, when an external additive fine particle is present as aggregates on the toner surface due to its small number average primary particle diameter, the particle diameter of primary particles forming the aggregates is measured.

[Specific Surface Area of an External Additive Fine Particle]

The BET specific surface area of a specific external additive fine particle is preferably 2-100 $m^2/g$.

Herein, the BET specific surface area refers to a specific surface area which is calculated using a BET adsorption isotherm equation from the adsorption amount of gas molecules such as nitrogen gas with a known adsorption occupying area.

When the BET specific surface area of a specific external additive fine particle falls within the above range, excessive burying of the external additive fine particle into a colored particle and excessive releasing from the surface of the colored particle are inhibited, whereby an environment, which stably functions for an external additive, is formed.

The BET specific surface area of a specific external additive fine particle is a value determined via a multipoint method (7-point method) using an automatic specific surface area analyzer "GEMINI 2360" (produced by Shimadzu-Micromeritics Instrument Corp.).

Specifically, initially, 2 g of an external additive fine particle is filled in a straight sample cell. As pretreatment, the content of the cell is replaced with nitrogen gas (purity: 99.9999%) for 2 hours, and thereafter nitrogen gas (purity: 99.999%) is adsorbed onto and desorbed from the external additive fine particle using the analyzer itself for calculation.

[Bulk Density of an External Additive Fine Particle]

The bulk density of a specific external additive fine particle is preferably 100-400 g/l.

Herein, the bulk density refers to a value obtained in such a manner that when an external additive fine particle is filled up in a container with a known capacity, the mass of the filled external additive fine particle is divided by the capacity; representing the existence degree of voids formed among external additive fine particles per unit volume in a state where the external additive fine particles are filled up.

When the bulk density of a specific external fine particle falls within the above range, a toner obtained positively ensures voids among toner particles, whereby packing during stationary storage tends not to occur. Therefore, adequate mobility can surely be maintained.

The bulk density of a specific external additive fine particle is a value determined using Kawakita-type bulk density meter "Type IH-2000" (produced by Seishin Enterprise Co., Ltd.).

Specifically, 50 g of a sample (specific external additive fine particle) is placed on a 120-mesh sieve, and the sieve is vibrated at a vibration intensity of 6 for 90 seconds. Then, the sample is dropped into a 100 ml container and vibration is terminated, followed by standing for 30 seconds. Thereafter, leveling of the sample across the opening of the container is carried out, and the mass thereof is measured to calculate the bulk density.

[Degree of Hydrophobization of an External Additive Fine Particle]

The degree of hydrophobization of a specific external additive fine particle is preferably at least 30%.

When the degree of hydrophobization of a specific external additive fine particle is at least 30%, there is exhibited an advantage such that adequate chargeability is realized even under an ambience of high temperature and humidity.

The degree of hydrophobization of a specific external additive fine particle refers to a value determined as follows.

Namely, 50 ml of water is placed in a 200 ml beaker, followed by addition of 0.2 g of an external additive fine particle (sample). While stirring using a magnetic stirrer, methanol is added from a burette whose tip is immersed in the water during dripping. Then, calculation is carried out using following Expression (1) from the dripped amount of the methanol (Me) until the external additive fine particle (sample), having initially floated, thoroughly sinks.

$$\text{the degree of hydrophobization (\%)}=[\text{Me (ml)}/(50+\text{Me (ml)})]\times 100 \quad \text{Expression (1)}$$

In a specific external additive fine particle, the existence ratio of silicon atoms in the surface layer thereof is higher than the existence ratio in the entire part.

As the specific external additive fine particle, preferable are those having a structure where a surface layer composed of a silica component is formed on the surface of a core particle composed of at least either of titanium and alumina components, since the effects of the present invention tend to be structurally realized. Herein, the core particle is preferably those composed of an oxide additionally incorporating a silicon atom.

In the case of such an embodiment, it is not necessary for the surface layer incorporating a silica component to fully cover the core particle. Accordingly, the existence ratio of the silica component determined by the mass using an X-ray photoelectron spectrometer is preferably 70-100%, more preferably 80-100%.

The existence ratio of silica is determined, specifically, using X-ray photoelectron spectrometer "ESCA-1000" (produced by Shimadzu Corp.) in the same manner as in a determination method for existence ratio $R_2$ of silicon atoms in the surface layer of the above specific external additive fine particle.

[Production Method of an External Additive Fine Particle]

Production methods of a specific external additive fine particle constituting the toner of the present invention are not specifically limited, including, for example, a pyrogenic process such as a gas phase method or a flame hydrolysis method; a sol-gel process; a plasma process; a precipitation process; a hydrothermal process; and a mining process, as well as mixed processes in combinations thereof. From the viewpoint of easily adjusting the existing location of atoms, the pyrogenic process is preferably used and there can be listed a production method employing the gas phase method disclosed in Examined Japanese Patent Application Publication No. 3202573.

A production method of an external additive fine particle via the gas phase method refers to a method of producing an external additive fine particle wherein raw materials for the external additive fine particle are introduced into high temperature flame in the form of vapor or powder to perform oxidization.

When a specific external additive fine particle, on the surface of which silicon atoms are oriented, is produced via a method of introducing raw materials into high temperature flame in the form of vapor (hereinafter also referred to as "gas phase method using vapor"), it is preferable from the viewpoint of production stability that, for example, vapor generated via heat-vaporization of at least either of a titanium atom source and an aluminum atom source is initially introduced into high temperature flame, and then a crystal is allowed to grow to some extent, followed by introduction of vapor generated via heat-vaporization of a silicon atom source.

As the silicon atom source, there are listed a silicon halide such as silicon tetrachloride and an organic silicon compound. The titanium atom source includes titanium sulfate and titanium tetrachloride, and the aluminum atom source includes aluminum chloride, aluminum sulfate, and sodium aluminate.

On the other hand, when a specific external additive fine particle, on the surface of which silicon atoms are oriented, is produced via a method of introducing raw materials into high temperature flame in the form of powder (hereinafter also referred to as "gas phase method using powder"), for example, in cases in which powder forming a core particle (hereinafter also referred to as "core particle forming powder") and powder forming the surface layer via modification of the surface (hereinafter also referred to as "modifying powder") are introduced into high temperature flame, it is preferable from the viewpoint of production stability that the size of the core particle forming powder is larger than that of the modifying powder.

The reason is thought to be that the core particle forming powder and the modifying powder are introduced into the same high temperature flame and then a plurality of powders are associated and grown to form particles of larger diameter; and therefore when the modifying powder is allowed to be a relatively minute particle, the heat receiving area of the modifying powder becomes increased, whereby the modifying powder is more easily melted. Therefore, for example, by controlling the temperature of high temperature flame, the magnitude of association and growth of the core particle forming powder is controlled to be small, and then there can be found conditions for melting and adhesion of the modifying powder without special trial and error.

As described above, it is presumed that when simultaneously introduced into high temperature flame, the core particle forming powder and the modifying powder mutually modify the surfaces thereof.

In this production method, a particle composed of a metal oxide, at least either of a titania and an alumina component, is used as a core particle forming powder. This core particle forming powder may be one composed of an oxide additionally incorporating a silicon atom.

A core particle forming powder via a metal oxide is obtained, for example, by burning a raw material of the metal oxide in flame. A raw material of such a metal oxide includes those listed above as a titanium atom source an aluminum atom source. These can be used individually or in combination.

In contrast, as a modifying powder, those composed of silica are used. Specifically, those obtained by burning a silicon atom source as listed above in high temperature flame are preferably used. Herein, as silica, an amorphous one is preferably used from the viewpoint of environmental safety.

It is preferable that silica is allowed to adhere to or be fused to the surface of a core particle by heat to the extent that the original shape of the silica is unobservable.

FIG. 1 is a schematic view showing one example of a production apparatus to produce an external additive fine particle constituting the toner of the present invention via a gas phase method using powder. Herein, a production apparatus to produce a specific external additive fine particle according to the present invention via a gas phase method using powder is not limited to the above.

In cases in which an external additive fine particle is produced via this gas phase method using powder, for example, an external additive fine particle incorporating a silicon atom, a titanium atom, and an aluminum atom can be produced, specifically, via the following process.

Namely, initially, core particle forming powder A stored in tank 21A for core particle forming powder A and modifying powder B stored in tank 21B for modifying powder B are introduced into main burner 26 equipped with an atomizing nozzle on the tip through introducing pipes 23A and 23B by quantitative supply pumps 22A and 22B, respectively, and are sprayed into combustion furnace 27 together with oxygen-water vapor mixed gas D to form high temperature flame 28 via auxiliary flame ignition.

Then, an external additive fine particle is formed via burning. This external additive fine particle is cooled together with exhaust gases in smoke path 29 and separated from the exhaust gases by cyclone 30 and bug filter 32, followed by trapping using collecting vessels 31 and 33, respectively. The exhaust gases having been separated from the external additive fine particle is exhausted by exhaust fan 34.

Herein, in FIG. 1, 21D represents a tank for oxygen-water vapor mixed gas D, and 23D represents an introducing pipe for the oxygen-water vapor mixed gas.

Figure 2:
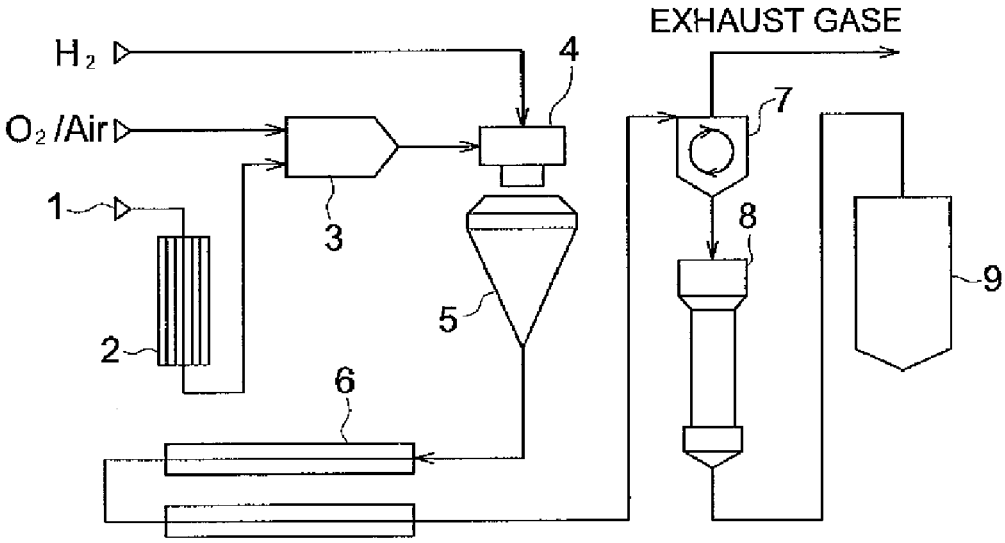
FIG. 2 A schematic view showing one example of a production apparatus to produce an external additive fine particle constituting the toner of the present invention via a gas phase method using vapor.

FIG. 2 is a schematic view showing one example of a production apparatus to produce an external additive fine particle constituting the toner of the present invention via a gas phase method using vapor. Herein, a production apparatus to produce a specific external additive fine particle according to the present invention via a gas phase method using vapor is not limited to the above.

In cases in which an external additive fine particle is produced via this gas phase method using vapor, for example, an external additive fine particle incorporating a silicon atom, a titanium atom, and an aluminum atom can be produced, specifically, via the following process.

(1) Initially, a silicon atom source, a titanium atom source, and an aluminum atom source are pumped from raw material inlet 1 and vaporized by heat in evaporator 2 to give silicon vapor, titanium vapor, and aluminum vapor.

(2) Subsequently, these vapors are introduced into mixing chamber 3 together with an inert gas such as nitrogen (not shown), and the resulting gas is mixed with at least either of dry air and oxygen gas, as well as hydrogen gas at a specified ratio to give a mixed gas. This mixed gas is introduced from combustion burner 4 into burning flame (not shown) generated in reaction chamber 5.

(3) Then, combustion treatment is carried out in burning flame at 1000° C.-3000° C. to form a particle incorporating a silicon atom, a titanium atom, and an aluminum atom.

(4) The thus-formed particle is cooled in cooler 6, and gaseous reaction products are separated and removed in separator 7. In this case, hydrogen chloride, which may have adhered to the particle surface in damp air, is removed. Further, in treatment chamber 8, deacidification treatment of the hydrogen chloride is carried out, followed by trapping using a filter to collect a composite oxide particle in silo 9.

In the production method as described above, the state where silicon atoms are oriented on the surface of a specific external fine particle is reflected by the flow ratio of silicon vapor, titanium vapor, and aluminum vapor introduced into burning flame, the timing of introduction of each vapor into the burning flame, burning duration, burning temperature, burning ambience, and other burning conditions. Therefore, in the present invention, to orient titanium atoms and aluminum atoms internally and silicon atoms on the surface, these conditions are preferably adjusted in a multiple manner.

The state where silicon atoms are oriented on the surface is realized in such a manner that, for example, the timing of introduction of silicon vapor introduced into burning flame is delayed, or the concentration of the silicon vapor in the entire vapor flowing is allowed to be relatively large in the posterior halt of the reaction.

Specifically, it is preferable from the viewpoint of production stability that at least either of titanium vapor and aluminum vapor with relatively low electrical resistance is initially introduced into burning flame (or in this case, the concentration of silicon vapor in the entire vapor flowing in the anterior half of the reaction is allowed to be relatively small) to grow a crystal to some extent; and thereafter, silicon vapor with relatively high electrical resistance is introduced (the concentration of silicon vapor in the entire vapor flowing in the posterior half of the reaction is allowed to be relatively large).

The thus-prepared composite oxide particle as such may be used as an external additive fine particle. However, this external additive fine particle is preferably hydrophobized.

The hydrophobization treatment method includes, for example, a dry type method as described below.

Namely, a hydrophobizing agent is diluted with a solvent such as tetrahydrofuran (THF), toluene, ethyl acetate, methyl ethyl ketone, acetone/ethanol, or hydrogen chloride-saturated ethanol. While a composite oxide particle is forced to stir using a blender, a dilute solution of the hydrophobizing agent is added via dripping or spraying for thorough mixing. In this case, there can be used an apparatus such as a kneader coater, a spray drier, a thermal processor, or a fluidized bed apparatus.

Subsequently, the thus-prepared mixture is moved to a vat and heated to dryness using an oven, followed by being again pulverized sufficiently using a mixer or a jet mill. The resulting pulverized product is preferably classified as appropriate. In the method as described above, when plural types of hydrophobizing agents are used for hydrophobization treatment, the treatment may be carried out using all of these hydrophohizing agents at the same time, or separate treatments may individually be conducted.

Further, other than such a dry type method, hydrophobization treatment may be carried out via a wet method including a method wherein a composite oxide particle is immersed in an organic solvent solution of a coupling agent and then dried, as well as a method wherein a composite oxide particle is dispersed in water to form a slurry, followed by dripping of an aqueous solution of a hydrophobizing agent, and then the composite oxide particle is deposited and dried by heat for pulverization.

In the hydrophobization treatment as described above, the temperature during heating is preferably at least 100° C. When the temperature during heating is less than 100° C., condensation reaction between the composite oxide particle and the hydrophobizing agent tends not be completed.

As hydrophobizing agents used for hydrophobization treatment, there are listed those used as common surface treatment agents including silane coupling agents such as hexamethyldisilaxane, titanate-based coupling agents, silicone oil, and silicone varnish. Further, there can be used fluorine-based silane coupling agents, fluorine-based silicone oil, coupling agents having an amino group or a quaternary ammonium salt group, and modified silicone oil. These hydrophobizing agents are preferably used by being dissolved in a solvent such as ethanol.

[Other External Additive Fine Particles]

External additive fine particles incorporated in the toner of the present invention are not limited to the specific external additive fine particles as described above, and other external additive fine particles may be used in combination.

As other external additive fine particles, lubricants such as various types of inorganic fine particles and organic fine particles, titanic acid compounds, or stearic acid metal salts can be used. For example, as inorganic fine particles, inorganic oxide fine particles such as silica, titania, or alumina are preferably used. Further, these inorganic fine particles are preferably hydrophobized with a silane coupling agent or a titanium coupling agent. As organic fine particles, those, which are spherical in shape featuring a number average primary particle diameter of about 10-2,000 nm, can be used. As such organic fine particles, polymers such as polystyrene, polymethyl methacrylate, or styrene-methyl methacrylate copolymer can be used.

Various types of these other external additive fine particles may be used in combination.

[Adding Treatment of External Additive Fine Particles]

A toner is produced by adding external additive fine particles as described above to a colored particle which forms the toner.

In addition of external additive fine particles, as a mixer used for addition thereof, a mechanical mixer such as a HENSCHEL mixer or a coffee mill can be used.

[Addition Ratio of External Additive Fine Particles]

With regard to the addition ratio of external additive fine particles, the addition ratio of a specific external additive fine particle is preferably 0.1-2.0% by mass based on a colored particle.

[Colored Particles]

A colored particle constituting the toner of the present invention incorporates at least a binder resin composed of a polyester resin and a colorant.

[Production Method of Colored Particles]

The colored particle constituting the toner as described above can be produced via so-called molecular growth of particles in an aqueous medium. Specifically, via granulation in an aqueous medium using oil droplets prepared from a colored particle forming material liquid wherein at least a polyester segment to form a polyester resin and a colorant are dissolved or dispersed in a solvent, a colored particle incorporating a binder resin composed of the polyester resin and the colorant can be produced.

The polyester segment to form a polyester resin can be obtained via polycondensation of a polyol and a polycarboxylic acid in the presence of a specific catalyst metal ion.

Such a specific catalyst metal ion is preferably supplied into a synthetic reaction system of a polyester segment in the form of a specific catalyst compound to be cited later.

Such a production method of a colored particle includes, for example, processes specifically described below.

The constitution includes the following processes:

(1-1) Polyester segment synthesis process to synthesize a polyester segment in the presence of a specific catalyst metal (1-2) Isocyanate modifying process to synthesize an isocyanate-modified polyester segment via isocyanate-modification of the polyester segment obtained in the above process (1-1)

(2) Preparation process of a colored particle forming material liquid to prepare a colored particle forming material liquid wherein the isocyanate-modified polyester segment obtained in the above process (1-2), a cross-linking agent (molecule elongation agent), and a colorant, as well as wax, if appropriate, are put together, followed by addition of a solvent (3) Dispersion process to form oil droplets by dispersing a colored particle forming material liquid in an aqueous medium (4) Molecule elongation process to obtain a polyester resin via molecule elongation in dispersed oil droplets (5) Aggregation process to allow oil droplets to be aggregated in an aqueous medium (6) Solvent removing process to obtain a colored particle by removing a solvent from aggregated oil droplets (7) Filtration and washing process to filter and isolate an obtained colored particle and to wash the colored particle for removal of surfactants therefrom (8) Drying process of a washed colored particle Such a production method will now be detailed.

(1-1) Polyester Segment Synthesis Process

This process is one wherein a polyol component and a polycarboxylic acid component are allowed to react together in the presence of a specific catalyst metal ion, preferably at 150-280° C., more preferably at 170-260° C., if appropriate, under reduced pressure to form a polyester segment having at least either of a hydroxyl group and a carboxyl group, while water generated is distilled off. Specifically, a mixture of a polyol component, a polycarboxylic acid component, and a specific catalyst compound is allowed to be present under a certain reaction condition to synthesize a polyester segment.

When the reaction temperature is less than 150° C., the duration required for reaction is prolonged and the solubility of a polycarboxylic acid component such as terephthalic acid to a polyol component may inadequately result. In contrast, when the reaction temperature is more than 280° C., raw materials may be decomposed.

[Polyol Components]

As a polyol component used to synthesize a polyester segment, an aromatic diol is preferably used. Such an aromatic diol includes, for example, bisphenols such as bisphenol A or bisphenol B, and alkylene oxide adducts of bisphenols such as ethylene oxide adducts thereof or propylene oxide adducts thereof. These can be used individually or in combination of at least 2 types thereof.

Further, in addition to such an aromatic diol, there may be added an aliphatic diol such as ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,7-heptane glycol, 1,8-octanediol, 1,9-nonanediol, 1,10-decanediol, 1,4-cyclohexanediol, or dipropylene glycol. In this case, the amount of an aromatic diol used is preferably at least 50% by mass of the entire diol components. When the amount of the aromatic diol is less than 50% by mass of the entire diol components, inadequate viscoelasticity results, resulting in occurrence of high temperature offset phenomena, whereby high speed fixability may insufficiently be realized.

Further, to adjust the melting point of a polyester resin, there may be added a minute amount of an aliphatic polyol having a valence of at least 3 including, for example, glycerin, trimethylol ethane, trimethylol propane, pentaerythritol, and sorbitol.

[Polycarboxylic Acid Components]

A polycarboxylic acid used to synthesize a polyester segment includes an aliphatic dicarboxylic acid such as oxalic acid, malonic acid, succinic acid, glutaric acid, adipic acid, suberic acid, azelaic acid, sebacic acid, pimelic acid, citraconic acid, maleic acid, fumaric acid, itaconic acid, glutaconic acid, isododecylsuccinic acid, isododecenylsuccinic acid, n-dodecylsuccinic acid, n-dodecenylsuccinic acid, n-octylsuccinic acid, or n-octenylsuccinic acid; and anhydrides or acid chlorides thereof. Further, other than the above aliphatic dicarboxylic acids, there are listed aromatic dicarboxylic acids such as phthalic acid, isophthalic acid, terephthalic acid, or naphthalene dicarboxylic acid. In order to realize appropriate melt viscosity of a polyester resin, a polycarboxylic acid having a valence of at least 3 such as trimellitic acid or pyromellitic acid may be used.

These can be used individually or in combination of at least 2 types thereof.

With regard to the used ratio of the polyol component and the polycarboxylic acid component, the equivalent ratio [OH]/[COOH] of a hydroxyl group [OH] of the polyol component to a carboxyl group [COOH] of the polycarboxylic acid component is preferably 1.5/1-1/1.5, more preferably 1.2/1-1/1.2.

When the used ratio of the polyol component and the polycarboxylic acid component falls within the above range, a polyester segment having a desired molecular weight can surely be obtained.

As a specific catalyst compound, there are listed an organic metal compound and a metal oxide, specifically an organic metal compound having a metal alcoholate skeleton. Specifically, a titanium compound supplying titanium as a specific catalyst metal includes titanium alkoxides such as tetranormalbutyl titanate, tetra(2-ethylhexyl) titanate, tetraisopropyl titanate, tetramethyl titanate, or tetrastearyl titanate; titanium acylates such as polyhydroxytitanium stearate; and titanium chelates such as titanium tetraacetylacetonate, titanium octylene glycolate, titanium ethylacetoacetate, titanium lactate, or titanium triethanol aminate.

And, as a germanium compound supplying germanium, germanium dioxide is exemplified.

Further, as an aluminum compound supplying aluminum, an oxide of polyaluminum hydroxide and an aluminum alkoxide are listed, and also tributyl aluminate, trioctyl aluminate, and tristearyl aluminate are exemplified.

These may be used individually or in combination of at least 2 types thereof.

The amount of a specific catalyst compound used is preferably 0.01-1.00% by mass based on the total amount of a polyol component and a polycarboxylic acid component used to form a polyester segment, including the specific catalyst compound.

Incidentally, the specific catalyst compound may be added either at the time of initiation of polycondensation reaction or in mid-course of the polycondensation reaction.

When a specific catalyst compound is added in mid-course of polycondensation reaction, the content ratio of a specific catalyst metal in a toner obtained can be controlled.

The glass transition point (Tg) of an obtained polyester segment is preferably 20-90° C., specifically preferably 35-65° C.

Further, the softening point of this aromatic diol-derived polyester segment is preferably 80-220° C., specifically preferably 80-150° C.

Herein, the glass transition point (Tg) and the softening point of a polyester segment is determined in the same manner as described above, provided that the polyester segment is used as a measurement sample.

With regard to a polyester segment obtained, the number average molecular weight (Mn) of a THF soluble part thereof based on gel permeation chromatography is preferably 2,000-10,000, more preferably 2,500-8,000, and the weight average molecular weight (Mw) is preferably 3,000-100,000, more preferably 4,000-70,000.

Herein, the molecular weight of the polyester segment is determined in the same manner as described above, provided that the polyester segment is used as a measurement sample.

(1-2) Isocyanate Modifying Process

This process is one wherein a polyisocyanate compound is allowed to react with a polyester segment synthesized in the above process (1-1) at 40-140° C. Thereby, at least either of a hydroxyl group and a carboxylic group at molecular terminals of the polyester segment is substituted with an isocyanate group to give an isocyanate-modified polyester segment. When a polyisocyanate compound is allowed to react, there can be used, as appropriate, a solvent inactive against the polyisocyanate compound, including ketones such as acetone, methyl ethyl ketone, or methyl isobutyl ketone; esters such as ethyl acetate; amides such as dimethylformamide or dimethylacetamide; ethers such as tetrahydrofuran; and aromatic solvents such as toluene or xylene.

[Polyisocyanate Compounds]

As a polyisocyanate compound allowed to react to isocyanate-modify such a polyester segment, there are listed aliphatic polyisocyanate compounds such as tetramethylene diisocyanate, hexamethylene diisocyanate, or 2,6-diisocyanate methylcaproate; alicyclic polyisocyanate compounds such as isophorone diisocyanate or cyclohexylmethane diisocyanate; aromatic diisocyanate such as tolylene diisocyanate or diphenylmethane diisocyanate; aromatic-aliphatic diisocyanate such as $\alpha,\alpha,\alpha',\alpha'$-tetramethylxylylene diisocyanate; isocyanurates; phenol derivatives of these isocyanate compounds; and those obtained by blocking these isocyanate compounds with oxime or caprolactam. These can be used individually or in combination of at least 2 types thereof.

(2) Preparation Process of Colored Particle Forming Material Liquid

This process is one wherein an isocyanate-modified polyester segment, a binder resin component composed of an amine cross-linking agent, and a colorant, as well as, as appropriate, toner constituting materials such as wax and a charge controller are dissolved or dispersed in an organic solvent to prepare a colored particle forming material liquid.

Herein, the polyester segment incorporated in a colored particle forming material liquid is not limited only to an isocyanate-modified polyester segment, and any appropriate unmodified polyester segment can be used together.

As an organic solvent used to prepare a colored particle forming material liquid, from the viewpoint of easy removal after colored particle formation, there are preferable those featuring relatively low boiling point and low solubility to water. Specifically, listed are, for example, methyl acetate, ethyl acetate, methyl ethyl ketone, methyl isobutyl ketone, toluene, and xylene. These can be used individually or in combination of at least 2 types thereof.

The amount of such an organic solvent used is commonly 1-300 parts by mass, preferably 1-100 parts by mass, more preferably 25-70 parts by mass, based on 100 parts by mass of an isocyanate-modified polyester segment.

[Amine Cross-Linking Agents]

As an amine cross-linking agent, listed are diamines including aromatic diamines such as phenylenediamine, diethyltoluenediamine, or 4,4'-diaminodiphenylmethane, alicyclic diamines such as 4,4'-diamino-3,3'-dimethyldicyclohexylmethane, diaminecyclohexane, or isophoronediamine, and aliphatic diamines such as ethylenediamine, tetramethylenediamine, or hexamethylenediamine; polyamines having a valence of at least 3 such as diethylenetriamine or triethylenetetramine; aminoalcohols such as ethanol amine or hydroxyethylaniline; aminomercaptanes such as aminoethylmercaptane or aminopropylmercaptane; amino acids such as aminopropionic acid or aminocapronic acid; and amino-blocked compounds such as a ketimine compound or an oxazolizine compound formed by blocking an amino group of the above amino acids via reaction with a ketone such as acetone, methyl ethyl ketone, or methyl isobutyl ketone. These may be used individually or in combination of at lest 2 types thereof.

In the production method of the present invention, a diamine compound is preferably used as an amine cross-linking agent. However, to allow the melt viscosity of a polyester resin to be appropriate, a diamine compound may be used in combination with a small amount of a polyamine having a valence of at least 3. The reason is that unreacted amino terminals remaining in the obtained polyester resin may make it difficult to achieve highly uniform charging of the toner.

Further, the molecular weight of the obtained polyester resin can be controlled optionally using an elongation-terminating agent. Such an elongation-terminating agent includes monoamines such as diethylamine, dibutylamine, butylamine, or laurylamine, and blocked compounds thereof such as a ketimine compound.

In a colored particle forming material liquid, the content of an amine cross-linking agent is allowed to be 0.1-5 parts by mass based on 100 parts by mass of an isocyanate-modified polyester segment.

[Colorants]

As a colorant constituting the toner of the present invention, any of a carbon black, a magnetic material, a dye, and a pigment may be used. As a carbon black, there can be used channel black, furnace black, acetylene black, thermal black, or lamp black. As a magnetic material, it is possible to use ferromagnetic metals such as iron, nickel, or cobalt; alloys containing these metals; ferromagnetic metal compounds such as ferrite or magnetite; alloys, which contain no ferromagnetic metals, capable of exhibiting ferromagnetism via heat treatment, such as Heusler-alloys, e.g., manganese-copper-aluminum and manganese-copper-tin; and chromium dioxide.

As a dye, there can be used C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, and C.I. Solvent Blue 95, and further mixtures thereof can be used. It is possible to use, as a pigment, C.I. Pigment Red 5, C.I. Pigment Red 48:1, C.I. Pigment Red 53:1, C.I. Pigment Red 57.1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Orange 31, C.I. Pigment Orange 43, C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, C.I. Pigment Green 7, C.I. Pigment Blue 15:3, and C.I. Pigment Blue 60, and further mixtures thereof can be used.

Wax optionally used is not specifically limited. Various types of waxes known in the art are usable. Examples thereof include hydrocarbon based waxes such as low molecular weight polyethylene wax, low molecular weight polypropylene wax, Fischer-Tropsch wax, microcrystalline wax, or paraffin wax; and ester waxes such as carnauba wax, pentaerythritol behenic acid ester, or behenyl citrate. These can be used individually or in combination of at least 2 types thereof.

Charge controllers optionally used are not specifically limited. Various types of charge controllers known in the art are usable. Specifically, there are listed nigrosine dyes, metal salts of naphthenic acid or higher fatty acids, alkoxylated amines, quaternary ammonium salt compounds, azo-based metal complexes, and salicylic acid metal salts or metal complexes thereof.

In the colored particle forming material liquid, the content of a colorant is, for example, 1-15% by mass, preferably 4-10% by mass based on the total amount of the solid materials contained in the colored particle forming material liquid.

Further, when the colored particle forming material liquid contains wax, the content of the wax is, for example, 2-20% by mass, preferably 3-18% by mass based on the total amount of the solid materials contained in the colored particle forming material liquid. Still further, when the colored particle forming material liquid contains a charge controller, the content of the charge controller is, for example, 0.1-2.5% by mass, preferably 0.5-2.0% by mass based on the total amount of the solid materials contained in the colored particle forming material liquid.

(3) Dispersion Process

This process is one wherein a colored particle forming material liquid obtained in the above process (2) is added in an aqueous medium, followed by being dispersed to form oil droplets having a controlled particle diameter so as for the particle diameter of a colored particle obtained to be a desired diameter.

Emulsifying dispersion of the colored particle forming material liquid can be carried out using mechanical energy. Homogenizers to perform emulsifying dispersion are not specifically limited, including a low-speed shearing homogenizer, a high-speed shearing homogenizer, a friction-type homogenizer, a high-pressure jet homogenizer, and an ultrasonic homogenizer. Specifically, "T. K. Homomixer" (produced by Tokushu Kika Kogyo Co., Ltd.) is exemplified.

The number average primary particle diameter of the oil droplets is preferably 60-1000 nm, more preferably 80-500 nm.

The number average primary particle diameter of the oil droplets is determined using electrophoretic light scattering spectrophotometer "ELS-800" (produced by Otsuka Electronics Co., Ltd.).

Herein, "aqueous medium" refers to a medium containing water at an amount of at least 50% by mass. As components other than water, water-soluble organic solvents are cited, including, for example, methanol, ethanol, isopropanol, butanol, acetone, methyl ethyl ketone, dimethylformamide, methyl cellosolve, and tetrahydrofuran. Of these, there are preferably used alcoholic organic solvents, which are organic solvents dissolving no resin, including methanol, ethanol, isopropanol, and butanol.

The amount of the aqueous medium used is preferably 50-2,000 parts by mass, more preferably 100-1,000 parts by mass, based on 100 parts by mass of a colored particle forming material liquid.

When the amount of the aqueous medium falls within the above range, emulsifying dispersion can be carried out so as for the colored particle forming material liquid to have a desired particle diameter.

A dispersion stabilizer is dissolved in the aqueous medium. Further, surfactants may also be added in the aqueous medium to enhance dispersion stability of oil droplets.

The dispersion stabilizer includes inorganic compounds such as tricalcium phosphate, calcium carbonate, titanium oxide, colloidal silica, or hydroxyapatite. Of these, an acid- or alkali-soluble dispersion stabilizer such as tricalcium phosphate is preferably used, since the dispersion stabilizer needs to be removed from a colored particle obtained. Further, in view of environmental concern, those being enzyme-degradable are preferably used.

Surfactants used include anionic surfactants such as alkylbenzenesulfonic acid salts, α-olefin sulfonic acid salts, or phosphoric acid esters; cationic surfactants including amine salt types such as alkylamine salts, aminoalcohol fatty acid derivatives, polyamine fatty acid derivatives, or imidazoline, and quaternary ammonium salt types such as alkyltrimethylammonium salts, dialkyldimethylammonium salts, alkyldimethylbenzylammonium salts, pyridinium salts, alkylisoquinolinium salts, or benzethonium chloride; nonionic surfactants such as fatty acid amide derivatives or polyol derivatives; and amphoteric surfactants such as alanine, dodecyl-di-(aminoethyl)glycine, di(octylaminoethyl)glycine, or N-alkyl-N,N-dimethylammonium betaine. Anionic or cationic surfactants, having a fluoroalky group, are also usable.

(4) Molecule Elongation Process

This process is one wherein an isocyanate group of an isocyanate-modified polyester segment is subjected to cross-linking reaction in oil-droplets using an amine cross-linking agent to form a urea bond, whereby molecule elongation is carried out to produce a urea-modified polyester resin; and then a polyester fine particle is produced wherein a colorant and, as appropriate, wax are incorporated in a binder resin composed of this polyester resin.

The cross-linking reaction time via an amine cross-linking agent (or molecule elongation time), depending on the kinds of a raw material and an amine cross-linking agent used, is preferably 1-24 hours, more preferably 2-15 hours. Further, the reaction temperature is preferably 20-100° C., more preferably 50-98° C.

In the above processes (2)-(4), an amine cross-linking agent is previously incorporated in oil-droplets (colored particle forming material liquid) in an aqueous medium. Alternatively, it is possible to employ a method in which an amine cross-linking agent is not previously incorporated in a colored particle forming material liquid; instead, the colored particle forming material liquid is dispersed in an aqueous medium to form oil-droplets; and thereafter an amine cross-linking agent is added in the aqueous medium. In this case, the amine cross-linking agent is supplied from the aqueous medium to the oil droplets, in which the isocyanate group of an isocyanate-modified polyester is subjected to cross-linking reaction with the amine cross-linking agent to form a urea bond, whereby a urea-modified polyester resin is produced.

(5) Aggregation Process

This process is one wherein a polyester fine particle obtained in the above process (4) is aggregated to form a colored particle.

Specifically, the dispersion stability of a polyester fine particle dispersed is allowed to decrease, whereby the polyester fine particle is aggregated. Further, specific methods are not specifically limited, provided that aggregation of the polyester fine particle occurs, including, for example, a method of raising the temperature of an aqueous medium having oil-droplets dispersed to decrease dispersion stabilizing ability and a method of adding a coagulant in the aqueous medium. Of these methods, the method of raising the temperature of an aqueous medium to decrease dispersion stabilizing ability is simpler and therefore preferable. In the method of raising the temperature of an aqueous medium, temperature to carry out aggregation of a polyester fine particle is not specifically limited, provided that aggregation of the polyester fine particle is carried out at the temperature. However, the temperature is, for example, 50-98° C., preferably 60-90° C. Continuation of aggregation of the polyester fine particle results in particle growth. Therefore, the duration of the aggregation is not specifically limited, provided that the duration results in growth to a desired particle diameter. However, the duration is, for example, 1-10 hours, preferably 2-8 hours. Further, the particle diameter of an obtained aggregated particle is not specifically limited, provided that the diameter is one required for forming a toner of a desired particle diameter.

In the above processes (4) and (5), there may concurrently be carried out molecule elongation reaction and aggregation of a polyester fine particle.

After completion of this aggregation process, shape control treatment is preferably conducted. In the shape control treatment, a dispersion of a colored particle obtained in the process (5) is subjected to passage treatment through a micrometer-order filter or stirring treatment using an annular-type continuous-stirring mill to carry out shape control so that the major/minor axis ratio of the colored particle falls within a prescribed range.

Specific methods of shape control of a colored particle include, for example, a method of passing the colored particle through a gap, a filter, or fine pores and a method of conducting shape control by applying centrifugal force to the colored particle via high-speed rotation. Further, as a specific shape control treatment apparatus of a colored particle include a piston type high-pressure homogenizer and an in-line screw pump, as well as the above annular type continuous-stirring mill.

A toner particle of a desired shape is realized by controlling factors such as the treatment duration, the treatment temperature, and the treatment speed for the shape control treatment.

Thus, shape control treatment of a colored particle is conducted to produce a colored particle having a major/minor axis ratio falling within a prescribed range.

(6) Solvent Removal Process

This process is a solvent removal process of removing an organic solvent from a colored particle. In this process, heating is carried by raising the temperature up to the boiling point of the organic solvent or higher. Surface properties of a particle formed can be adjusted by controlling the solvent removal rate. Namely, when the solvent removal rate is increased, unevenness can be formed on the surface, resulting in an enhanced amorphous shape.

Specifically, external heating is conducted during solvent removal at a temperature higher than the boiling point of a solvent, preferably at a temperature of the boiling point plus 5-20° C., further under reduced pressure at the same time as heating, specifically, at 1-300 hpa to form unevenness. When the heating temperature is excessively high, the resulting shape is unable to fall within the range of the present invention. Similarly, when the reduced pressure condition is beyond the above range, no control within the range of the present invention is realized.

Also during this solvent removal of an organic solvent, via the existence of a specific catalyst metal ion or a specific catalyst metal compound, aggregation of a colorant can be inhibited, and then the colorant exists in a polyester resin in an enhanced dispersion state maintained, whereby a toner with enhanced dispersibility of the colorant can be prepared.

(7) Filtration and Washing Process

In this filtration and washing process, there are carried out filtration treatment wherein a colored particle dispersion obtained in the process (6) is cooled and a colored particle is filtered and separated via solid-liquid separation of the colored particle from this cooled colored particle dispersion; and washing treatment to remove adhered materials such as a surfactant from the filtered and separated colored particle (cake-shaped accumulated substance). Specific methods of solid-liquid separation and washing include a centrifugal separation method, a filtration method under reduced pressure using a Buchner funnel, and a filtration method using a filter press. However, these are not specifically limited.

(8) Drying Process

In this drying process, a washed colored particle is dried. Driers used in this drying process include a spray drier, a vacuum freeze drier, a vacuum drier, a stationary tray drier, a transportable tray drier, a fluid layer drier, a rotary type drier, and a stirring type drier. However, these are not specifically limited. Herein, the moisture content of a dried colored particle is preferably at most 5% by mass, more preferably at most 2% by mass.

Herein, determination of the moisture content in a colored particle is carried out via Karl-Fischer coulometric titration. Specifically, automatic thermal vaporization moisture measuring system "AOS-724" (produced by Hiranuma Sangyo Co., Ltd.) constituted of aquameter "AO-6", "AQI-601" (an interface for AQ-6), and thermal vaporization apparatus "LE-24S" is used. After standing for 24 hours under an ambience of 20° C. and 50% RH, 0.5 g of a colored particle, precisely weighed, is placed in a 20 ml glass sample tube and the tube is tightly sealed using a silicone rubber packing coated with TEFLON (a trademark) to determine the moisture content present in this sealed ambience via measuring conditions and reagents described below. Further, to calibrate the moisture content present in the sealed ambience, two empty sample tubes are measured simultaneously.

Sample heating temperature: 110° C.

Sample heating duration: 1 minute

Nitrogen gas flow rate: 150 ml/minute

Reagents: Counter electrode liquid (cathode liquid): HYDRANAL (a trademark) Coulomat CG-K; generation liquid (anode liquid): HYDRANAL (a trademark) Coulomat AK Further, when aggregates of dried colored particles are formed thereamong via weak interparticle attractive force, the aggregates may be pulverized. Herein, mechanical pulverizing apparatuses such as a jet mill, a HENSCHEL mixer, a coffee mill, or a food processor may be used as a pulverizing apparatus.

The constitution according to the production method of a colored particle as described above is that a specific catalyst compound is used as a catalyst in synthesis of a polyester segment and allowed to remain. Therefore, at the time when expressing a dispersibility providing function, this specific catalyst compound is homogeneously present in a polyester resin, whereby this specific catalyst metal compound is oriented toward a colorant. Then, enhanced dispersibility of the colorant can effectively be realized. Accordingly, a colored particle can surely be produced wherein the colored particle is incorporated in a polyester resin with extremely enhanced dispersibility.

[Developer]

The toner of the present invention is suitably used in any of the following exemplified cases: the toner is used as a single-component magnetic toner incorporating a magnetic material; the toner is used as a so-called two-component developer by mixing with a carrier; and the toner is used on its own as a ton-magnetic toner.

When the toner of the present invention is used as a two-component developer by mixing with a carrier, occurrence of toner filming (carrier contamination) with respect to the carrier can be prevented. In the case of use as a single-component developer, occurrence of toner filming with respect to a triboelectric charging member of the developing unit can be prevented.

As a carrier constituting a two-component developer, usable are magnetic particles composed of conventionally known materials including metals such as iron, ferrite, or magnetite or alloys of the above metals with metals such as aluminum or lead. Specifically ferrite particles are preferably used.

The volume average particle diameter of the carrier is preferably 15-100 μm, more preferably 25-60 μm. It is possible to determine the volume average particle diameter of a carrier, typically, using laser diffraction system particle size distribution meter "HELOS" (produced by Sympatec Co.) equipped with a wet type homogenizer.

As the carrier, there is preferably used a carrier further coated with a resin or a so-called resin dispersion type carrier prepared by dispersing magnetic particles in a resin. A resin composition for such coating is not specifically limited. There are used, for example, an olefin based resin, a styrene based resin, a styrene-acrylic based resin, a silicone based resin, an ester based resin, and a fluorine-containing polymer based resin. A resin constituting the resin dispersion type carrier is not also specifically limited, and any of those known in the art may be used, including, for example, a styrene-acrylic based resin, a polyester resin, a fluorine based resin, and a phenol based resin.

[Image Forming Method]

Any of the above toners can suitably be used for an image forming method incorporating a fixing process based on a contact heating method. In this image forming method, specifically, using any of the toners described above, an electrostatic latent image, for example, electrostatically formed on an image carrier, is developed by charging a developer with a triboelectric charging member in the developing unit to form a toner image, which is transferred onto an image support. Then, the transferred toner image on the image support is fixed thereon via fixing treatment employing the contact heating method to obtain a visible image.

[Fixing Method]

As a preferable fixing method using the toner of the present invention, a so-called contact heating method is exemplified. The contact heating method specifically includes a heat pressure fixing method, a heating roller fixing method, and a pressure contact heating fixing method using a rotatable pressing member incorporating a fixed and arranged heating body.

In a fixing method employing the heating roller fixing method, a fixing unit is commonly used, which is composed of a top roller provided with a heat source in a metal cylinder made of metal such as iron or aluminum coated with a resin such as a fluorine resin; and a bottom roller made of, for example, silicone rubber.

A line-shaped heater is used as the heat source which heats the top roller up to a surface temperature of about 120-200° C. Pressure is applied between the top roller and the bottom roller, and then with this pressure, the bottom roller is deformed, resulting in formation of a so-called nip at the deformed portion. The width of the nip is 1-10 mm, preferably 1.5-7 mm. The fixing line speed is preferably 40 mm/second-600 mm/second. When the nip width is excessively small, heat tends not to be uniformly applied to the toner, whereby fixing non-uniformity may occur. In contrast, when the nip width is excessively large, melting of a polyester resin incorporated in the toner particle is promoted, whereby fixing offset may occur.

[Image Supports]

An image support used in an image forming method employing the toner of the present invention is a support carrying a toner image. Specifically, there are listed various kinds of supports including plain paper, bond paper, and coated printing paper such as art paper or coated paper, being thin to thick, as well as Japanese paper, postcard paper, OHP plastic films, and cloths available on the market; however, being not limited thereto.

According to any of the toners as described above, when constituent toner particles are composed of a polyester resin and have a specified small particle diameter, an image of high image quality is basically obtained. And, with such specified narrow particle diameter dispersibility, existence of toner particles having an excessively small or large particle diameter can be inhibited, whereby enhanced adhesion among the toner particles is realized during fixing. Further, with a specified amorphous shape, the vacant space among the toner particles can be minimized, whereby further enhanced adhesion among the toner particles is realized during fixing, resulting in no diffusion of the toner. Therefore, in an obtained image, thin-line reproducibility and high image density are realized. Further, since a specific catalyst metal is incorporated at a specified ratio and also a specific external additive fine particle is incorporated, high image density can be realized over a long term period.

Unclear is the reason why since a specific catalyst metal is incorporated at a specified ratio and also a specific external additive fine particle is incorporated, high image density can be realized over a long term period. However, it is presumed that via the interaction between the specific catalyst metal and a polyester resin, an ionic cross-linking structure is formed, and a portion, where this ionic cross-linking structure has been formed, functions as a charge generating point, resulting in stable charge providing properties; further, the specific external additive fine particle can inhibit excessive charge accumulation, resulting in an excellent balance between charge providing properties and charge accumulation inhibiting properties; and thereby, high image density can be realized over a long term period.

An embodiment of the present invention has specifically been described above, but the embodiments of the present invention are not limited to the above examples and various variations can be made.

EXAMPLES

Examples of the present invention will now be described that by no means limit the scope of the present invention.

Production Example 1 of an External Additive Fine Particle

Using the production apparatus shown in FIG. 2, vapor of silicon tetrachloride [A], vapor of titanium tetrachloride [B], and aluminum chloride [C] were introduced into a reaction chamber at a flow rate listed in the column of Initial Stage Introduction Amount of Table 1, together with an inert gas, and then a mixed gas of hydrogen and air at a specified mixture ratio was burnt at a burning temperature of 2,000° C. for 0.3 second to produce a composite particle incorporating silicon atoms, titanium atoms, and aluminum atoms, which was collected on a filter after cooling.

The thus-obtained composite particle was heated in an oven in air ambience at 500° C. for 1 hour for dechlorination treatment. Thereafter, 500 parts by mass thereof was placed in a high-speed stirring mixer equipped with a heating and cooling jacket, and then while stirring at 500 rpm, 25 parts by mass of purified water was supplied via spraying in a closed state, followed by stirring for 10 minutes more. Subsequently, 25 parts by mass of hexamethyldisilaxane was added and then stirring was carried out for 60 minutes in the closed state. Then, nitrogen was allowed to flow at 150° C. while stirring, and ammonia gas generated and the residual treatment agents were removed to obtain external additive fine particle [1] composed of a composite oxide particle.

Coefficient $(R_1)/(R_2)$, the number average primary particle diameter, the BET specific surface area, the bulk density, and the degree of hydrophobization of obtained external additive fine particle [1] are shown in Table 1. Herein, coefficient $(R_1)/(R_2)$, the number average primary particle diameter, the BET specific surface area, the bulk density, and the degree of hydrophobization were determined based on the above determination procedures.

Production Examples 2-5 of External Additive Fine Particles

External additive fine particles [2]-[5] were obtained in the same manner as in production example 1 of an external additive fine particle, except that vapor of silicon tetrachloride [A], vapor of titanium tetrachloride [B], and aluminum chloride [C] were introduced, as initial-stage reaction raw materials, into a reaction chamber from a main route at a flow rate listed in the column of Initial Stage Introduction Amount of Table 1, and also introduced, as later-stage reaction raw materials, into the reaction chamber from another route (not shown) at a flow rate listed in the column of Later Stage Introduction Amount of Table 1 to produce a composite particle incorporating silicon atoms, titanium atoms, and aluminum atoms.

Coefficients $(R_1)/(R_2)$, the number average primary particle diameters, the BET specific surface areas, the bulk densities, and the degrees of hydrophobization of obtained external additive fine particles [2]-[5] are shown in Table 1.

Production Examples 6-10 and 13-15 of External Additive Fine Particles

External additive fine particles [6]-[10] and external additive fine particles [13]-[15] were obtained in the same manner as in production example 1 of an external additive fine particle, except that the raw materials introduced into the reaction furnace from the combustion burner were changed to the raw materials having the mixture ratios shown in Table 1.

Coefficients $(R_1)/(R_2)$, the number average primary particle diameters, the BET specific surface areas, the bulk densities, and the degrees of hydrophobization of obtained external additive fine particles [6]-[10] and external additive fine particles [13]-[15] are shown in Table 1.

Production Example 11 of an External Additive Fine Particle

Titanium dioxide particle [t] obtained in the same manner as in production example 14 of an external additive fine particle and silica powder [s] obtained in the same manner as in production example 13 of an external additive fine particle were previously mixed in a resin bag at a mass ratio of 9:1. Using the production apparatus shown in FIG. 1, the resulting mixture was placed in the tank and transported through the introducing pipe together with air, serving as a carrier gas, at a supply rate of 4 kg/hour to be ejected from the nozzle. In this case, a nozzle ejection flow rate of air was 48 m/second.

After reaction, cooled air was introduced into the combustion furnace to allow the high temperature residence time in the combustion furnace to be at most 0.3 second. Thereafter, using a bug filter made of polytetrafluoroethylene, fine powder [P] produced was collected.

Fine powder [P] collected was heated in an oven in air ambience at 500° C. for 1 hour for dechlorination treatment. Thereafter, 500 parts by mass thereof was placed in a high-speed stirring mixer equipped with a heating and cooling jacket, and then while stirring at 500 rpm, 25 parts by mass of purified water was supplied via spraying in a closed state, followed by stirring for 10 minutes more. Subsequently, 25 parts by mass of hexamethyldisilaxane was added and stirring was carried out for 60 minutes in the closed state. Thereafter, heating was carried out while stirring, and then nitrogen was allowed to flow at 150° C. for removing ammonia gas generated and the residual treatment agents to obtain external additive fine particle [11].

Coefficient $(R_1)/(R_2)$, the number average primary particle diameter, the BET specific surface area, the bulk density, and the degree of hydrophobization of thus-obtained external additive fine particle [11] are shown in Table 1.

Production Example 12 of an External Additive Fine Particle

External additive fine particle [12] was obtained in the same manner as in production example 11 of an external additive fine particle except that instead of titanium dioxide particle [t], aluminum oxide [a] obtained in the same manner as in production example 15 of an external additive fine particle was used.

Coefficient $(R_1)/(R_2)$, the number average primary particle diameter, the BET specific surface area, the bulk density, and the degree of hydrophobization of thus-obtained external additive fine particle [12] are shown in Table 1.

TABLE 1

| External Additive Fine Particle No. | Production Method | Initial Stage Introduction Amount (%) Si [A] | Ti [B] | Al [C] | Later Stage Introduction Amount (%) Si [A] | Ti [B] | Al [C] | Constituent Element (%) Si | Ti | Al | Coefficient $R_1/R_2$ | *2 | BET Specific Surface Area ($m^2/g$) | Bulk Density (g/l) | *3 |
|---|---|---|---|---|---|---|---|---|---|---|---|---|---|---|---|
| 1 | *1 | 12 | 65 | 23 | — | — | — | 10 | 70 | 20 | 0.98 | 50 | 43 | 133 | 50 |
| 2 | *1 | 12 | 65 | 23 | 20 | 57 | 23 | 21 | 56 | 23 | 0.7 | 52 | 43 | 133 | 51 |
| 3 | *1 | 12 | 65 | 23 | 24 | 53 | 23 | 25 | 47 | 23 | 0.5 | 51 | 42 | 131 | 51 |
| 4 | *1 | 12 | 65 | 23 | 20 | 80 | — | 20 | 62 | 18 | 0.25 | 55 | 42 | 131 | 55 |
| 5 | *1 | 8 | 65 | 23 | 10 | 67 | 230 | 10 | 67 | 23 | 1 | 21 | 45 | 130 | 41 |
| 6 | *1 | 1.5 | 98.5 | — | — | — | — | 1 | 99 | — | 0.97 | 22 | 48 | 122 | 42 |
| 7 | *1 | 3 | 97 | — | — | — | — | 2.2 | 97.8 | — | 0.98 | 110 | 30 | 200 | 60 |
| 8 | *1 | 20 | 80 | — | — | — | — | 19 | 81.3 | — | 0.97 | 120 | 20 | 200 | 62 |
| 9 | *1 | 23 | 77 | — | — | — | — | 22 | 78.2 | — | 0.98 | 20 | 60 | 400 | 40 |
| 10 | *1 | 12 | — | 88 | — | — | — | 10 | — | 90 | 0.97 | 50 | 93 | 46 | 50 |
| 11 | Powder Method | 10 | 90 | — | 40 | 60 | — | 25 | 75 | — | 0.625 | 55 | 42 | 130 | 55 |
| 12 | Powder Method | 10 | — | 90 | 40 | — | 60 | 25 | — | 75 | 0.625 | 57 | 42 | 130 | 56 |
| 13 | *1 | 100 | — | — | — | — | — | 100 | — | — | 1 | 40 | 41 | 128 | 45 |
| 14 | *1 | — | 100 | — | — | — | — | — | 100 | — | — | 21 | 43 | 131 | 41 |
| 15 | *1 | — | — | 100 | — | — | — | — | — | 100 | — | 15 | 87 | 50 | 35 |

*1: Gas Phase Method,
*2: Number Average Primary Particle Diameter (nm)
*3: Degree of Hydrophobization (%)

In Table 1, the initial stage introduction amount, the later stage introduction amount, and the constituent element each are expressed in percent by mass.

Production Example 1 of a Colored Particle (Synthesis of Polyester Segment [a1])

A reaction vessel equipped with a stirrer and a nitrogen introducing pipe was charged with 724 parts by mass of 2-mol ethylene oxide adduct of bisphenol A, 200 parts by mass of isophthalic acid, 70 parts by mass of fumaric acid, and 0.3 part by mass (0.03% by mass) of tetranormalbutyl titanate. Reaction thereof was conducted under ordinary pressure at 220° C. for 7 hours, followed by further reaction under reduced pressure of 10 mmHg for 4 hours, and then cooling was carried out to 160° C. Subsequently, 32 parts by mass of phthalic acid anhydride was added, followed by reaction for 2 hours to obtain polyester segment [a1]. The glass transition point Tg, the softening point, the number average molecular weight (Mn), and the weight average molecular weight (Mw) of polyester segment [a1] were 52° C., 108° C., 4,300, and 22,000, respectively.

(Synthesis of Isocyanate-Modified Polyester Segment [A1])

There was added 2,000 parts by mass of ethyl acetate to 1,000 parts by mass of above polyester segment [a1], followed by addition of 120 parts by mass of isophorone diisocyanate, and then reaction was performed at 80° C. for 2 hours to obtain isocyanate-modified polyester segment [A1].

(Formation of a Colored Particle)

In a mixing vessel equipped with a liquid seal (reflux apparatus) and a stirrer, there were mixed 900 parts by mass of ethyl acetate, 300 parts by mass of isocyanate-modified polyester segment [A1], 4 parts by mass of copper phthalocyanine blue, 4 parts by mass of carbon black, 15 parts by mass of pentaerythritol tetrastearate, and 5 parts by mass of isophoronediamine at a mixture temperature of 20° C. for 2 hours to obtain a colored particle forming material liquid.

On the other hand, 600 parts by mass of ion-exchanged water, 60 parts by mass of methyl ethyl ketone, 60 parts by mass of tricalcium phosphate, and 0.3 part by mass of sodium dodecylbenzene sulfonate were placed in another reaction vessel. Then, while stirring at 30° C. at 15,000 rpm for 3 minutes using "T.K. Homomixer" (produced by Tokushu Kika Kogyo Co., Ltd.), the above colored particle forming material liquid was added to be dispersed as oil droplets of a number average primary particle diameter of 0.5 μm in this aqueous medium. Thereafter, while stirring using a common mixer instead of the above mixer at 300 rpm, the system temperature was raised to 80° C., followed by stirring for 3 hours to conduct molecule elongation reaction and aggregation of a polyester fine particle obtained by this reaction. The volume based median diameter of the thus-obtained aggregated particle was 6.9 μm. Then, the temperature was raised to 90° C. to remove the ethyl acetate. The ethyl acetate was thoroughly removed and then cooling was carried out to room temperature, followed by addition of 150 parts by mass of 35% concentrated hydrochloric acid to elute tricalcium phosphate present on the toner surface. Subsequently, solid-liquid separation was carried out, and the thus-prepared dehydrated toner cake was redispersed in ion-exchanged water, followed by solid-liquid separation repeated 3 times for washing. Then, drying was carried out at 40° C. for 24 hours to obtain colored particle [1].

Production Examples 2-9 of Colored Particles

Colored particles 2-9 were obtained in the same manner as in production example 1 of a colored particle except that with regard to the metal catalyst and the added amount thereof in the synthesis process of polyester segment [a1], "0.3% by mass of tetranormalbutyl titanate" was changed to those based on Table 2.

Herein, colored particles [8] and [9] are comparative colored particles.

Production Example 10 of a Colored Particle

Comparative colored particle 10 was obtained in the same manner as in production example 2 of a colored particle except that the removing temperature of ethyl acetate was changed from 90° C. to 80° C.

Production Example 11 of a Colored Particle

Comparative colored particle 11 was obtained in the same manner as in production example 2 of a colored particle except that the removing temperature of ethyl acetate was changed from 90° C. to 98° C.

TABLE 2

| Colored Particle No. | Catalyst Compound | Added Amount (part by mass) | Tg (° C.) | Tsp (° C.) | Mn | Mw |
|---|---|---|---|---|---|---|
| 1 | tetranormalbutyl titanate | 0.3 | 54 | 113 | 8000 | 34000 |
| 2 | tetranormalbutyl titanate | 3 | 54 | 115 | 7900 | 40000 |
| 3 | tetranormalbutyl titanate | 10 | 58 | 116 | 7600 | 41000 |
| 4 | tetraisopropyl titanate | 3 | 56 | 113 | 6700 | 34600 |
| 5 | titanium octylene glycolate | 3 | 59 | 114 | 8300 | 38000 |
| 6 | germanium dioxide | 2.5 | 54 | 114 | 7900 | 39000 |
| 7 | trioctyl aluminate | 8 | 54 | 114 | 7900 | 39500 |
| 8 | tributyltin | 2 | 56 | 116 | 6000 | 41500 |
| 9 | germanium dioxide | 3 | 59 | 116 | 7000 | 42000 |
| 10 | tetranormalbutyl titanate | 3 | 54 | 114 | 7900 | 38500 |
| 11 | tetranormalbutyl titanate | 3 | 54 | 114 | 7900 | 39000 |

Production Example 1 of a Toner

Mixed were 100 parts by mass of colored particle [1], 2 parts by mass of external additive fine particle [1], 1 part by mass of hydrophobic silica (number average particle diameter: 7 nm), 1.0 part by mass of hydrophobic silica (number average particle diameter: 21 nm) using a HENSCHEL mixer to obtain toner [1]. Herein, the rotor peripheral speed of the HENSHCEL mixer was 35 m/second and mixing was carried out at 32° C. for 20 minutes, followed by passing through a sieve of an opening size of 45 μm.

With regard to toner [1] obtained, the volume based median diameter ($D_{50}$), the degree of average circularity, and the volume based particle diameter dispersibility ($CV_{VOL}$ value) were 5.6 μm, 0.969, and 19, respectively. The content ratio of a specific catalyst metal (titanium) was 10 ppm. Further, the glass transition point (Tg), the softening point, the number average molecular weight (Mn), and the weight average molecular weight (Mw) were 54° C., 113° C., 8,000, and 34,000, respectively.

Production Examples 2-25 of Toners

Toners [2]-[25] were obtained in the same manner as in production example 1 of a toner except that instead of colored particle [1] and external additive fine particle [1], as a colored particle and an external additive fine particle, those based on Table 3 or Table 4 were used. The volume based median diameter ($D_{50}$), the degree of average circularity, and the volume based particle diameter dispersibility ($CV_{VOL}$ value), the content ratio of a specific catalyst metal, the glass transition point (Tg), the softening point, the number average molecular weight (Mn), and the weight average molecular weight (Mw) of each of toners [2]-[25] obtained are listed in Table 3 and Table 4.

Herein, toners [1]-[4], [6]-[12], and [16]-[21] are used for examples of the present invention, and toners [5], [13]-[15], and [22]-[25] are used for comparative examples.

TABLE 3

| | Toner No. | Colored Particle No. | External Additive Fine Particle No. | Degree of Average Circularity | $C_{50}$ (μm) | $CV_{VOL}$ Value | Catalyst Metal | Content (ppm) | Tg (° C.) | Tsp (° C.) | Mn | Mw |
|---|---|---|---|---|---|---|---|---|---|---|---|---|
| Example 1 | 1 | 2 | 1 | 0.969 | 5.6 | 19 | Ti | 500 | 54 | 115 | 7900 | 40000 |
| Example 2 | 2 | 2 | 2 | 0.969 | 5.6 | 19 | Ti | 500 | 54 | 115 | 7900 | 40000 |
| Example 3 | 3 | 2 | 3 | 0.969 | 5.6 | 19 | Ti | 500 | 54 | 115 | 7900 | 40000 |
| Example 4 | 4 | 2 | 4 | 0.969 | 5.6 | 19 | Ti | 500 | 54 | 115 | 7900 | 40000 |
| Comparative Example 1 | 5 | 2 | 5 | 0.969 | 5.6 | 19 | Ti | 500 | 54 | 115 | 7900 | 40000 |
| Example 5 | 6 | 2 | 6 | 0.969 | 5.6 | 19 | Ti | 500 | 54 | 115 | 7900 | 40000 |
| Example 6 | 7 | 2 | 7 | 0.969 | 5.6 | 19 | Ti | 500 | 54 | 115 | 7900 | 40000 |
| Example 7 | 8 | 2 | 8 | 0.969 | 5.6 | 19 | Ti | 500 | 54 | 115 | 7900 | 40000 |
| Example 8 | 9 | 2 | 9 | 0.969 | 5.6 | 19 | Ti | 500 | 54 | 115 | 7900 | 40000 |
| Example 9 | 10 | 2 | 10 | 0.969 | 5.6 | 19 | Ti | 500 | 54 | 115 | 7900 | 40000 |
| Example 10 | 11 | 2 | 11 | 0.969 | 5.6 | 19 | Ti | 500 | 54 | 115 | 7900 | 40000 |
| Example 11 | 12 | 2 | 12 | 0.969 | 5.6 | 19 | Ti | 500 | 54 | 115 | 7900 | 40000 |

TABLE 3-continued

| | Toner No. | Colored Particle No. | External Additive Fine Particle No. | Degree of Average Circularity | $C_{50}$ (μm) | $CV_{VOL}$ Value | Catalyst Metal | Content (ppm) | Tg (° C.) | Tsp (° C.) | Mn | Mw |
|---|---|---|---|---|---|---|---|---|---|---|---|---|
| Comparative Example 2 | 13 | 2 | 13 | 0.969 | 5.6 | 19 | Ti | 500 | 54 | 115 | 7900 | 40000 |
| Comparative Example 3 | 14 | 2 | 13 + 14 | 0.969 | 5.6 | 19 | Ti | 500 | 54 | 115 | 7900 | 40000 |
| Comparative Example 4 | 15 | 2 | 13 + 15 | 0.969 | 5.6 | 19 | Ti | 500 | 54 | 115 | 7900 | 40000 |

TABLE 4

| | Toner No. | Colored Particle No. | External Additive Fine Particle No. | Degree of Average Circularity | $C_{50}$ (μm) | $CV_{VOL}$ Value | Catalyst Metal | Content (ppm) | Tg (° C.) | Tsp (° C.) | Mn | Mw |
|---|---|---|---|---|---|---|---|---|---|---|---|---|
| Example 12 | 16 | 1 | 2 | 0.968 | 5.6 | 19 | Ti | 10 | 54 | 113 | 8000 | 34000 |
| Example 13 | 17 | 3 | 2 | 0.968 | 5.6 | 19 | Ti | 1500 | 58 | 116 | 7600 | 41000 |
| Example 14 | 18 | 4 | 2 | 0.967 | 5.6 | 18 | Ti | 520 | 56 | 113 | 6700 | 34600 |
| Example 15 | 19 | 5 | 2 | 0.968 | 5.6 | 19 | Ti | 550 | 59 | 114 | 8300 | 38000 |
| Example 16 | 20 | 6 | 2 | 0.968 | 5.6 | 19 | Ge | 1200 | 54 | 114 | 7900 | 39000 |
| Example 17 | 21 | 7 | 2 | 0.968 | 5.6 | 19 | Al | 400 | 54 | 114 | 7900 | 39500 |
| Comparative Example 5 | 22 | 8 | 2 | 0.969 | 5.6 | 19 | Sn | 800 | 56 | 116 | 6000 | 41500 |
| Comparative Example 6 | 23 | 9 | 2 | 0.969 | 5.6 | 19 | Ti | 1600 | 59 | 116 | 7000 | 42000 |
| Comparative Example 7 | 24 | 10 | 2 | 0.995 | 5.6 | 19 | Ti | 500 | 54 | 114 | 7900 | 38500 |
| Comparative Example 8 | 25 | 11 | 2 | 0.94 | 5.6 | 19 | Ti | 500 | 54 | 114 | 7900 | 39000 |

Production Example of a Carrier

Manganese-magnesium ferrite of a weight average particle diameter of 50 μm was spray-coated with a coating agent composed of 85 parts by mass, as a solid substance, of a silicone resin (oxime curing type, a toluene solution), 10 parts by mass of γ-aminopropyltrimethoxysilane (coupling agent), 3 parts by mass of alumina particles (particle diameter: 100 nm), and 2 parts by mass of carbon black, and then fired at 190° C. for 6 hours, followed by returning to room temperature to obtain a resin coating type carrier. The average thickness of the resin coat was 0.2 μm.

Production Example of a Developer

Using a V type mixer, 6 parts by mass of each of thus-produced toners [1]-[25] and 94 parts by mass of the thus-produced carrier were mixed to produce developers [1]-[25], respectively. Herein, with regard to this mixing treatment, when the charged amount of the toner reached 20-23 μC/g, mixing was stopped, and then the resulting mixture was temporarily discharged into a polyethylene pot.

Examples 1-17 and Comparative Examples 1-8

With regard to above toners [1]-[25], using digital copier "bizhub 750" (a model with 75-sheet capacity for A4 black and white copying, produced by Konica Minolta Business Technologies, Ind.), evaluations described below were carried out under an ambience of high temperature and humidity (temperature: 35° C. and humidity: 85% RH).

Namely, these evaluations were carried out in such a manner that an original image of a pixel ratio of 5% was printed on 200,000 sheets of paper in a sheet-by-sheet intermittent mode wherein the image was printed on one sheet, followed by a 5-second intermission; before and after the above printing, each of a solid black image of a size of 5 cm×5 cm, a thin-line image prepared by printing thin lines of resolutions of 1 line/mm-8 lines/mm incremented by a resolution of 1 line/mm in a ⅛ area of paper separately, and a solid white image was printed on a separate sheet of paper; and then image density evaluation was conducted using the initial solid black image and the solid black image after 200,000 sheet printing and thin-line reproducibility was evaluated using the initial thin-line image and the thin-line image after 200,000 sheet printing, and also fog density was evaluated using the initial solid white image and the solid white image after 200,000 sheet printing. The results are listed in Table 5.

Image density was evaluated in such a manner that: using reflection densitometer "RD-918" (produced by Macbeth Co.), the absolute reflection density of printing paper was set at "0" and relative reflection densities at random 10 locations were measured, and then the arithmetic average value was designated as the image density.

Thin-line reproducibility was evaluated in such a manner that a maximum resolution, wherein thin lines were distinguishable with a magnifier of a magnification of 10, was designated as an indicator for the thin-line reproducibility.

Fog density was evaluated in such a manner that using reflection densitometer "RD-918" (produced by Macbeth Co.), the absolute reflection density of printing paper was set at "0" and relative reflection densities at random 10 locations were measured, and then the arithmetic average value was designated as the fog density.

Herein, when image density is at least 1.30, it can be said that adequate image density is realized. Further, with regard to thin-line reproducibility, higher resolution is preferable. Still further, when fog density is at most 0.005, it can be said that such fog is not practically problematic.

TABLE 5

| | | Initial Stage | | | After 200,000 Sheet Printing | | |
|---|---|---|---|---|---|---|---|
| | Toner No. | Image Density | Thin-line Reproducibility | Fog Density | Image Density | Thin-line Reproducibility | Fog Density |
| Example 1 | 1 | 1.41 | 8 | 0.000 | 1.37 | 7 | 0.002 |
| Example 2 | 2 | 1.41 | 8 | 0.000 | 1.40 | 8 | 0.001 |
| Example 3 | 3 | 1.41 | 8 | 0.000 | 1.41 | 8 | 0.001 |
| Example 4 | 4 | 1.41 | 8 | 0.000 | 1.41 | 8 | 0.001 |
| Comp. 1 | 5 | 1.41 | 8 | 0.000 | 1.28 | 5 | 0.008 |
| Example 5 | 6 | 1.41 | 8 | 0.000 | 1.36 | 7 | 0.002 |
| Example 6 | 7 | 1.41 | 8 | 0.000 | 1.37 | 7 | 0.002 |
| Example 7 | 8 | 1.41 | 8 | 0.000 | 1.37 | 7 | 0.002 |
| Example 8 | 9 | 1.41 | 8 | 0.000 | 1.38 | 7 | 0.002 |
| Example 9 | 10 | 1.41 | 8 | 0.000 | 1.37 | 7 | 0.002 |
| Example 10 | 11 | 1.41 | 8 | 0.000 | 1.39 | 7 | 0.002 |
| Example 11 | 12 | 1.41 | 8 | 0.000 | 1.39 | 7 | 0.002 |
| Comp. 2 | 13 | 1.41 | 8 | 0.000 | 1.29 | 5 | 0.008 |
| Comp. 3 | 14 | 1.41 | 8 | 0.000 | 1.29 | 5 | 0.007 |
| Comp. 4 | 15 | 1.41 | 8 | 0.000 | 1.28 | 5 | 0.008 |
| Example 12 | 16 | 1.41 | 8 | 0.000 | 1.40 | 8 | 0.002 |
| Example 13 | 17 | 1.41 | 8 | 0.000 | 1.39 | 8 | 0.002 |
| Example 14 | 18 | 1.41 | 8 | 0.000 | 1.40 | 8 | 0.001 |
| Example 15 | 19 | 1.41 | 8 | 0.000 | 1.40 | 8 | 0.001 |
| Example 16 | 20 | 1.41 | 8 | 0.000 | 1.38 | 7 | 0.002 |
| Example 17 | 21 | 1.41 | 8 | 0.000 | 1.41 | 8 | 0.001 |
| Comp. 5 | 22 | 1.41 | 8 | 0.000 | 1.31 | 6 | 0.007 |
| Comp. 6 | 23 | 1.41 | 8 | 0.000 | 1.29 | 6 | 0.007 |
| Comp. 7 | 24 | 1.41 | 8 | 0.000 | 1.35 | 6 | 0.006 |
| Comp. 8 | 25 | 1.41 | 8 | 0.000 | 1..35 | 6 | 0.007 |

Comp.: Comparative Example

The results shown in Table 5 clearly showed that in examples 1-17 of the toner of the present invention, high thin-line reproducibility and high image density were able to be sufficiently realized even in long-term use.

What is claimed is:

1. A toner comprising colored particles and external additive particles, wherein the colored particles comprise a binder resin made of a polyester resin and a colorant;

wherein the toner has a degree of average circularity of 0.950-0.990, a volume based median diameter of 4.5-8.0 μm, a volume based particle diameter dispersibility ($CV_{VOL}$ value) of 15-25, a metal selected from titanium, germanium, and aluminum incorporated at a ratio of 10-1500 ppm;

wherein external additive particles comprise a complex oxide incorporating silicon atoms and at least one of titanium atoms and aluminum atoms; and wherein a coefficient $(R_1)/(R_2)$ is less than 1.0, provided that the surface existing ratio of the silicon atoms $(R_2)$ is defined as a value obtained from a weight of silicon atoms in the surface divided by the total weight of the silicon atoms, the titanium atoms and the aluminum atoms in the surface; and the average existing ratio of the silicon atoms $(R_1)$ is defined as a value obtained from a weight of silicon atoms in the entirety of the external additive particles divided by the total weight of the silicon atoms, the titanium atoms and the aluminum atoms in the entirety of the external additive particles.

2. The toner of claim 1, wherein an amount of the silicon atoms contained in the external additive particles is 49% or less of the total amount of the silicon atoms, the titanium atoms and the aluminum atoms in the external additive particles.

3. The toner of claim 1, wherein a number average primary particle diameter of the external additive particles is 20 to 200 nm.

4. The toner of claim 1, wherein the coefficient of $(R_1)/(R_2)$ of the external additive particles is 0.7 or less.

5. The toner of claim 1, wherein the coefficient $(R_1)/(R_2)$ of the external additive particles is 0.5 or less.

6. The toner of clam claim 1, wherein coefficient $(R_1)/(R_2)$ of the external additive particles is 0.25 or less.

7. The toner of claim 1, wherein the amount of the silicon atoms contained in the external additive particles is 1-20% of the total amount of the silicon atoms, the titanium atoms and the aluminum atoms in the external additive particles.

8. The toner of claim 1, wherein a BET of the external additive particles is 2-100 $m^2/g$.

9. The toner of claim 1, wherein a bulk density of the external additive particles is 100-400 g/l.

10. The toner of claim 1, wherein a degree of hydrophobization of the external additive particles is 30% or more.

11. The toner of claim 1, wherein an added amount of the external additive particles is 0.1-2.0% based on the amount of the colored particles.

* * * * *